US006150065A

United States Patent [19]

Kobayashi et al.

[11] Patent Number: 6,150,065

[45] Date of Patent: Nov. 21, 2000

[54] ELECTROPHOTOGRAPHIC PHOTORECEPTOR

[75] Inventors: Tohru Kobayashi; Yoko Aoki; Mamoru Yamada; Yoshimasa Matsushima; Hiroshi Sugiyama; Toshimitsu Hagiwara, all of Hiratsuka; Hajime Suzuki, Kofu, all of Japan

[73] Assignee: Takasago International Corporation, Tokyo, Japan

[21] Appl. No.: 09/285,712

[22] Filed: Apr. 5, 1999

[30] Foreign Application Priority Data

Apr. 3, 1998 [JP] Japan ..... 10-091411
Apr. 3, 1998 [JP] Japan ..... 10-091783

[51] Int. Cl.[7] ..... G03G 5/09

[52] U.S. Cl. ..... 430/83; 430/56

[58] Field of Search ..... 430/58.85, 56, 430/83

[56] References Cited

U.S. PATENT DOCUMENTS 4,751,163 6/1988 Hagiwara et al. ..... 430/58.85

FOREIGN PATENT DOCUMENTS 3-136058 6/1991 Japan .

OTHER PUBLICATIONS

Chemical Abstracts 116:140076, 1992.

*Primary Examiner*—Christopher D. Rodee
*Attorney, Agent, or Firm*—Kubovcik & Kubovcik

[57] ABSTRACT

Disclosed is a charge transfer material which is highly soluble in a binder resin, does not precipitates crystals and produces no pinhole and also disclosed is an electrophotographic photoreceptor comprising the charge transfer material which comprises a butadiene compound represented by the formula (I):

(I)

wherein $R^1$ and $R^2$, which may be the same or different, respectively represent a lower alkyl group having 1–4 carbon atoms or a phenyl group or benzyl group which may have a substituent and $R^3$, $R^4$ and $R^5$, which may be the same or different, respectively represent a hydrogen atom, a halogen atom, a lower alkyl group, a lower alkoxy group having 1–4 carbon atoms or a halogen atom; and a butadiene compound represented by the general formula (II):

(II)

wherein $R^1$, $R^2$, $R^3$, $R^4$ and $R^5$ are the same as above, and the content of the butadiene compound of the formula (I) is at least 60% by weight based on the total amount by weight of the butadiene compounds of the formulae (I) and (II).

4 Claims, 2 Drawing Sheets

ELECTROPHOTOGRAPHIC PHOTORECEPTOR

BACKGROUND OF THE INVENTION

1. Field of the invention

The present invention relates to an electrophotographic photoreceptor comprising specific butadiene compounds as an essential component. The present invention also relates to an electrophotographic photoreceptor comprising an electroconductive support on which a photosensitive layer is placed, which layer contains specific butadiene compounds as an essential component. The present invention also relates to the electrophotographic photoreceptor which is desirably used in image forming apparatus such as laser printers and LED printers.

2. Prior Art

Considerable studies on an electrophotographic photoreceptor comprising organic photoconductive compounds have been made in recent years in view of the fact that these electrophotographic photoreceptors give a superior performance, e.g., light weight, high surface smoothness, low toxicity, easy productivity and low prices, compared with those containing inorganic photoconductive compounds. As the electrophotographic photoreceptor comprising organic photoconductive compounds, a so-called functional separation type electrophotographic photoreceptor having a structure which is functionally separated into a charge generating layer and a charge transfer layer has attracted considerable attention.

Various materials have been proposed for addition to the charge generating layer or in the charge transfer layer.

Among these various materials, charge transfer materials having various properties have been exploited and proposed (for instance, U.S. Pat. No. 3,791,826).

Examples of the charge transfer materials include 1,1,4,4-tetraphenylbutadiene derivatives having at least one substituted amino group disclosed in Japanese Patent Publication (JP-B) No. H5-19701,1-(p-aminophenyl)-1,4,4-triphenylbutadiene derivatives or 1,1-bis(p-aminophenyl)-4,4-diphenylbutadiene derivatives disclosed in JP-B No. H7-21646.

JP-B No. H7-27244 proposes an electrophotographic photoreceptor comprising these tetraphenylbutadiene derivatives as the charge transfer materials and oxotitanium phthalocyanine as the charge generating material. Further, Japanese Patent Application Laid-Open (JP-A) No. H5-134428 proposes an electrophotographic photoreceptor comprising tetraphenylbutadiene derivative as the charge transfer material and a specific polycarbonate resin as a polymer binder.

However, the characteristics of these electrophotographic photoreceptors comprising these tetraphenylbutadiene derivatives as the charge transfer materials are unsatisfactory.

SUMMARY OF THE INVENTION

Accordingly, an object of the present invention is to provide an electrophotographic photoreceptor which has many advantages and fulfills the requirements desired conventionally. The electrophotographic photoreceptor specifically comprises a charge transfer material which is highly soluble in a binder polymer, and which can form a stable organic thin film with high density and has a high carrier mobility. The electrophotographic photoreceptor also has high sensitivity and lowered residual potential.

Another object of the present invention is to provide an electrophotographic photoreceptor which has such excellent characteristics required for electrophotographic sensitive materials that optical fatigue of the photosensitive material due to its repeated use and a rise in residual voltage can be prevented.

The present invention provides an electrophotographic photoreceptor comprising a butadiene compound represented by the general formula (I):

(I)

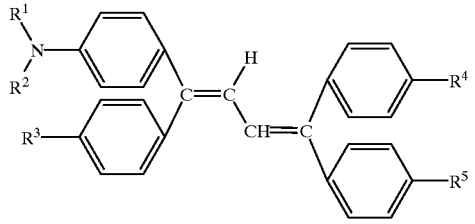

wherein $R^1$ and $R^2$, which are the same or different, represent a lower alkyl group having 1–4 carbon atoms or an optionally substituted phenyl group or an optionally substituted benzyl group and $R^3$, $R^4$ and $R^5$, which are the same or different, represent a hydrogen atom, a halogen atom, a lower alkyl group having 1–4 carbon atoms, a lower alkoxy group having 1–4 carbon atoms or a halogen atom; and a butadiene compound represented by the general formula (II):

(II)

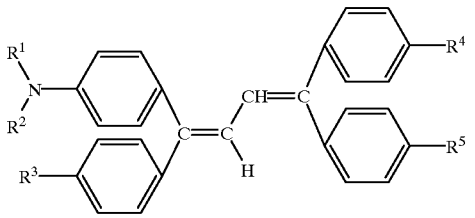

wherein $R^1$, $R^2$, $R^3$, $R^4$ and $R^5$ are the same as above, wherein the butadiene compound represented by the formula (I) is at least 60% by weight based on the total amount by weight of the butadiene compounds represented by the formulae (I) and (II).

The present invention also provides an electrophotographic photoreceptor comprising an electroconductive support on which a photosensitive layer is placed, said photosensitive layer containing at least a charge generating material, a charge transfer material and a binder resin, wherein the charge transfer material comprises a butadiene compound represented by the general formula (I):

(I)

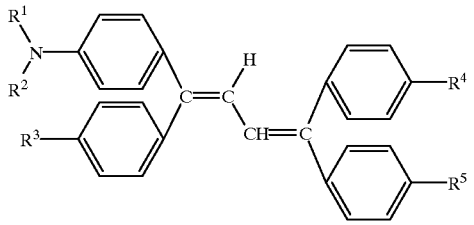

wherein $R^1$ and $R^2$, which are the same or different, represent a lower alkyl group having 1–4 carbon atoms or an optionally substituted phenyl group or an optionally substituted benzyl group and $R^3$, $R^4$ and $R^5$, which are the same or different, represent a hydrogen atom, a halogen atom, a lower alkyl group having 1–4 carbon atoms, a lower alkoxy group having 1–4 carbon atoms or a halogen atom; and a butadiene compound represented by the general formula (II):

(II)

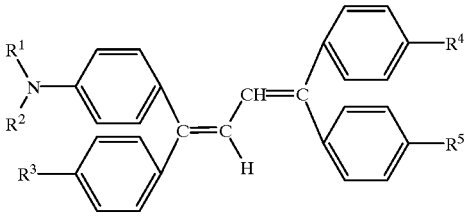

wherein $R^1$, $R^2$, $R^3$, $R^4$ and $R^5$ are the same as above, and the content of the butadiene compound represented by the formula (I) is at least 60% by weight based on the total amount by weight of the butadiene compounds represented by the formulae (I) and (II).

In one form of the invention, the charge generating material in the photosensitive layer is a phthalocyanine pigment.

In another form of the invention, the charge transfer material in the photosensitive layer comprises a butadiene compound represented by the general formula (III):

(III)

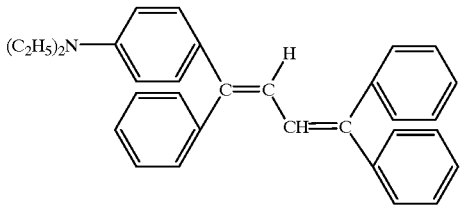

and a butadiene compound represented by the general formula (IV):

(IV)

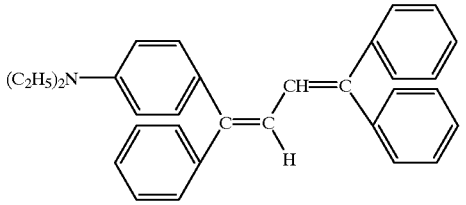

and the butadiene compound represented by the formula (III) is at least 60% by weight based on the total amount by weight of the butadiene compounds represented by the formulae (III) and (IV).

Incidentally, the ratio of the amount by weight of the butadiene compound of the formula (I) to the total amount by weight of the butadiene compounds of the formulae (I) and (II) is referred to as a "ratio of trans-isomer". That is, the weight-ratio of (butadiene compound (I))/(butadiene compound (I)+butadiene compound (II)) and hence the weight-ratio of (butadiene compound (III))/(butadiene compound (III)+butadiene compound (IV)) are referred to as a "ratio of trans-isomer".

DETAILED DESCRIPTION OF THE INVENTION

Figure 1A:
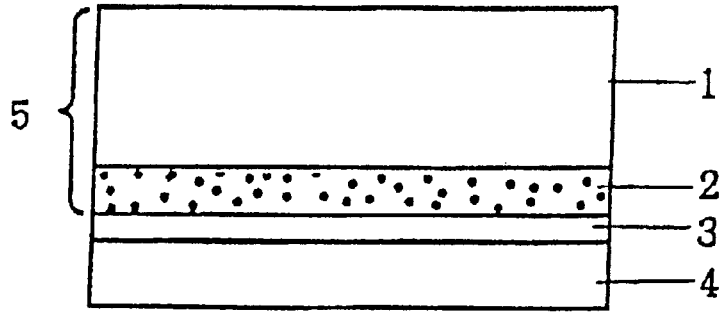
FIGS. 1(*a*) to 1(*c*) are views showing layer structures of electrophotographic photoreceptors comprising a charge transfer materials of the present invention.

The present invention will be hereinafter explained in more detail.

In the present invention, the butadiene compounds represented by the aforementioned general formulae (I) and (II), specifically, 1-(p-aminophenyl)-1,4,4-triphenylbutadiene derivatives, are used as the charge transfer materials. In the aforementioned formulae, $R^1$ and $R^2$ respectively represent a lower alkyl group having 1–4 carbon atoms or a phenyl group or benzyl group which may have a substituent. As the lower alkyl group having 1–4 carbon atoms, a methyl group, ethyl group or n-propyl group is preferred. Preferable examples of the phenyl group include a phenyl group, phenyl group substituted with a lower alkyl group having 1–4 carbon atoms, phenyl group substituted with a halogen atom and phenyl group substituted with a lower alkoxy group having 1–4 carbon atoms and, among these groups, a phenyl group, m-tolyl group, p-tolyl group or p-methoxyphenyl group is particularly preferred. Preferable examples of the benzyl group include a benzyl group, benzyl group substituted with a lower alkyl group having 1–4 carbon atoms, benzyl group substituted with a halogen atom and benzyl group substituted with a lower alkoxy group having 1–4 carbon atoms.

In $R^3$, $R^4$ and $R^5$ which respectively represent a hydrogen atom, lower alkyl group having 1–4 carbon atoms, lower alkoxy group having 1–4 carbon atoms or halogen atom, a methyl group is particularly preferable as the lower alkyl group having 1–4 carbon atoms, a methoxy group, ethoxy group or n- or iso-propoxy group is preferable as the lower alkoxy group having 1–4 carbon atoms with a methoxy group being particularly preferable and a chlorine atom is particularly preferable as the halogen atom.

Preferred specific examples of trans-isomers, that is, 1-(p-aminophenyl)-1,4,4-triphenylbutadiene derivative compounds are shown in Table 1 below provided that these specific compounds are only indicated as preferable materials and, accordingly, the charge transfer material which can be used in the present invention is not limited to these specific compounds.

TABLE 1

| Example compound | $R^1$ | $R^2$ | $R^3$ | $R^4$ | $R^5$ |
|---|---|---|---|---|---|
| 1 | Me | Me | H | H | H |
| 2 | Me | Me | Me | H | H |
| 3 | Me | Me | OMe | H | H |
| 4 | Me | Me | H | Me | H |
| 5 | Me | Me | H | Me | Me |
| 6 | Me | Me | H | Cl | H |
| 7 | Me | Me | H | Cl | Cl |
| 8 | Et | Et | H | H | H |
| 9 | Et | Et | Me | H | H |
| 10 | Et | Et | OMe | H | H |
| 11 | Et | Et | H | Me | H |
| 12 | Et | Et | H | Me | Me |
| 13 | Et | Et | H | Cl | H |
| 14 | Et | Et | H | Cl | Cl |
| 15 | n-Pr | n-Pr | H | H | H |

TABLE 1-continued

| Example compound | $R^1$ | $R^2$ | $R^3$ | $R^4$ | $R^5$ |
|---|---|---|---|---|---|
| 16 | n-Pr | n-Pr | Me | H | H |
| 17 | n-Pr | n-Pr | OMe | H | H |
| 18 | n-Pr | n-Pr | H | Me | H |
| 19 | n-Pr | n-Pr | H | Me | Me |
| 20 | n-Pr | n-Pr | H | Cl | H |
| 21 | n-Pr | n-Pr | H | Cl | Cl |
| 22 | Ph | Ph | H | H | H |
| 23 | Ph | Ph | Me | H | H |
| 24 | p-Tol | Ph | OMe | H | H |
| 25 | p-Tol | p-Tol | H | Me | H |
| 26 | m-Tol | Ph | H | Me | Me |
| 27 | p-MeOPh | Ph | H | H | H |
| 28 | Ph | Me | H | H | H |
| 29 | Ph | Et | H | H | H |
| 30 | Et | Et | H | OMe | OMe |
| 31 | Bn | Et | H | H | H |
| 32 | Bn | Bn | H | H | H |

The abbreviations in Table 1 represent the following groups or compounds:

Me: a methyl group, Et: an ethyl group, n-Pr: a n-propyl group, Ph: a phenyl group, p-Tol: a p-tolyl group, m-Tol: a m-tolyl group, p-MeOPh: a p-methoxyphenyl group, OMe: a methoxy group, Bn: a benzyl group, and Cl: a chlorine atom.

The 1-(p-aminophenyl)-1,4,4-triphenylbutadiene derivative represented by the aforementioned general formula (I) or (II) is synthesized, for example, by the following method. In the following formulae, $R^1$ to $R^5$ are the same as above.

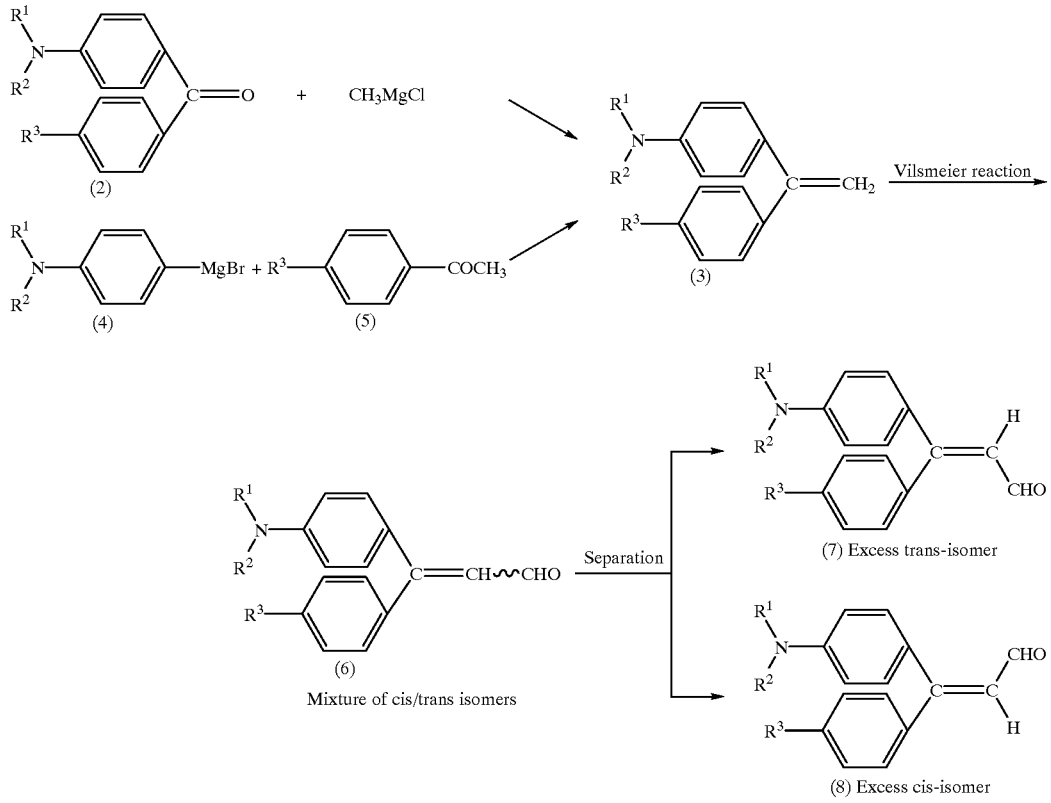

-continued

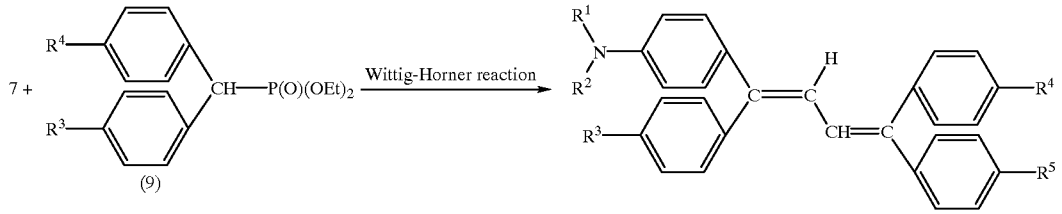

First, a Grignard's reagent prepared from methyl chloride and magnesium is reacted with p-amino substituted benzophenone (2), followed by dehydration, to obtain 1,1-diphenylethylene derivative (3). Alternatively, the 1,1-diphenylethylene derivative (3) can be synthesized by reacting a Grignard's reagent, prepared from p-amino substituted bromobenzene, with an acetophenone compound (5), followed by dehydration. Next, a Vilsmeier reagent prepared from phosphorus oxychloride and N,N-dimethylformamide is reacted with the 1,1-diphenylethylene derivative (3) to obtain a 3,3-diphenylacrolein derivative (6). This 3,3-diphenylacrolein derivative (6) which is a mixture of a cis-isomer and a trans-isomer is subjected to a treatment using column chromatography or recrystallization treatment or a combination of these treatments to obtain a 3,3-diphenylacrolein derivative (7) embracing excess trans-isomers. The compound (7) and a diethyl 1,1-diphenylmethyl phosphonate derivative (9) are condensed by a Wittig-Horner reaction to synthesize 1-(p-aminophenyl)-1,4,4-triphenylbutadiene derivative (1) embracing excess tans-isomers (the ratio of trans-isomer≧0.6).

Alternatively, the compound represented by the aforementioned general formula (I) or (II) may be synthesized, for example, by the following method. In the following formulae, $R^1$ to $R^5$ are the same as above.

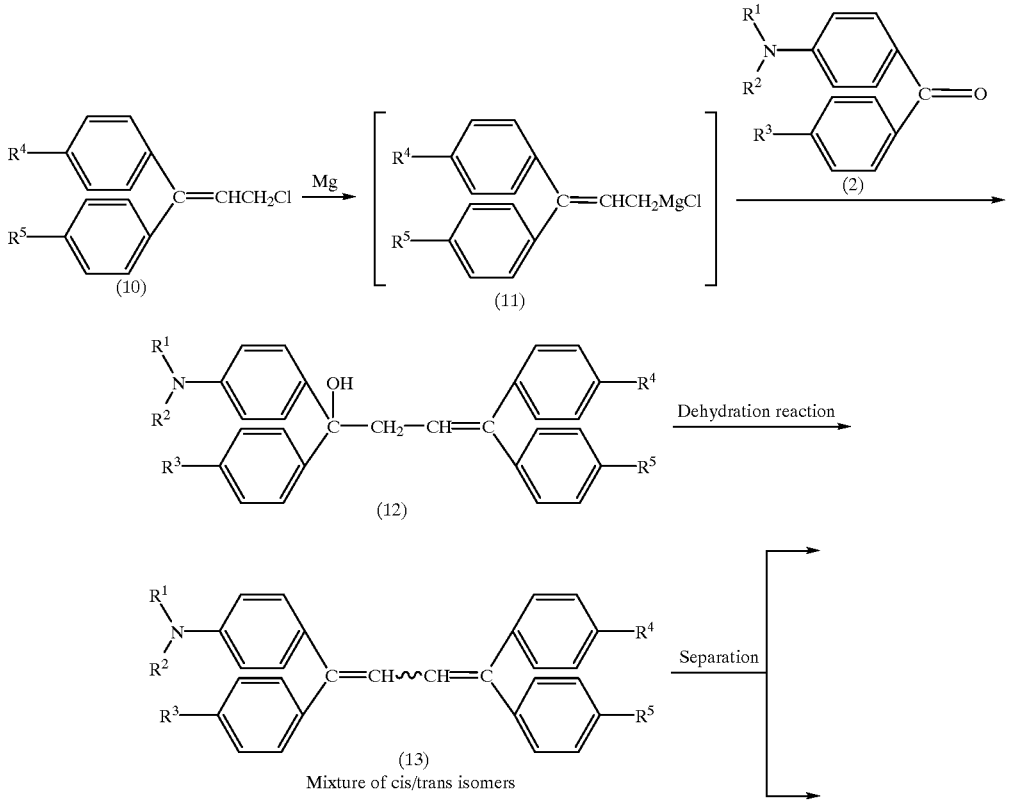

-continued

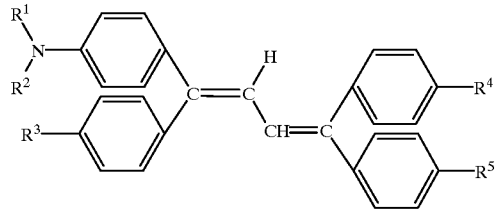

(1) Excess trans-isomer

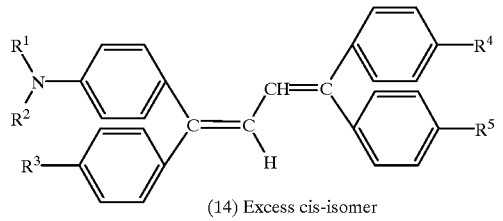

(14) Excess cis-isomer

First, 3,3-diphenylallyl chloride derivative (10) is prepared using the method described in JP-A No. H7-173112. A Grignard's reagent (11) prepared from the above 3,3-diphenylallyl chloride derivative (10) is reacted with a benzophenone derivative (2) to obtain a carbinol (12). The resulting compound (12) is mixed with an acid such as paratoluenesulfonic acid to cause a dehydration reaction thereby preparing butadiene (13) embracing a mixture of cis-isomers and trans-isomers. This butadiene (13) is subjected to a treatment using column chromatography or recrystallization treatment or a combination of these treatments to synthesize 1-(p-aminophenyl)-1,4,4-triphenylbutadiene derivative (1) embracing excess trans-isomers (ratio of trans-isomer≧0.6).

Figure 1B:
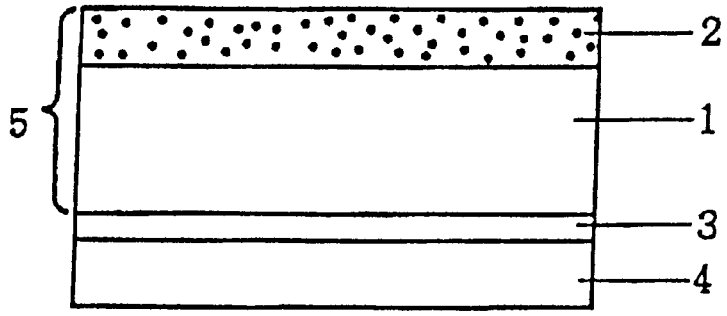
Figure 1C:
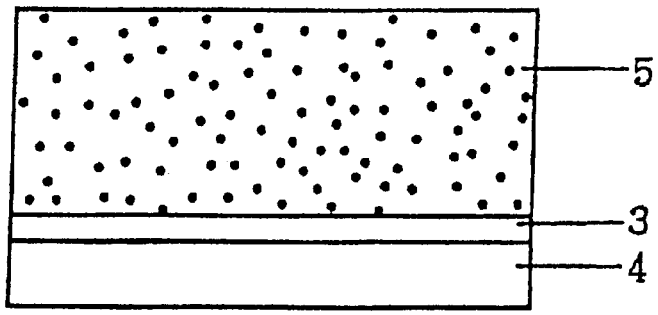

A mixture of 1-(p-aminophenyl)-1,4,4-triphenylbutadiene derivatives represented by the general formulae (I) and (II) in which the ratio of trans-isomer is more than 0.6 is specifically used as the charge transfer material either of the charge transfer layer in a function separation type electrophotographic photoreceptor which is functionally separated into a charge generating layer and a charge transfer layer on an electroconductive support or of the photosensitive layer containing the charge generating material and the charge transfer material in the same layer. To explain the structure of the photosensitive material in more detail with reference to FIG. 1, the photosensitive material may be either the type in which a charge transfer layer 1 is laminated on a charge generating layer 2 formed on an electroconductive support 4 as shown in FIG. 1*a* or the type in which the charge transfer layer 1 is laminated under the charge generating layer 2 as shown in FIG. 1*b*. It is preferable to use the type in which a charge transfer layer is laminated on a charge generating layer. As shown in FIG. 1*c*, a single layer-type electrophotographic photoreceptor comprising one or more charge generating materials and one or more charge transfer materials in the same layer 5 may be used. The layer 5 is formed on a primary coating layer 3 placed on the electroconductive support 4.

The charge transfer layer of the electrophotographic photoreceptor according to the present invention can be formed either by depositing only a mixture of 1-(p-aminophenyl)-1,4,4-triphenylbutadiene derivatives, represented by the general formulae (I) and (II) in which the ratio of trans-isomer is more than 0.6, as it is on the electroconductive support or on the charge generating layer or by dissolving the derivative compounds and a binder in an appropriate solvent to prepare a solution and by applying this solution to the electroconductive support or to the charge generating layer, followed by drying. On the other hand, the single layer-type electrophotographic photoreceptor comprising the charge generating material and the charge transfer material according to the present invention can be formed by dissolving or dispersing the charge generating material and the charge transfer material containing a mixture of compounds of formula (I) and (II), in which the ratio of trans-isomer is more than 0.6, together with a binder in an appropriate solvent and by applying the prepared solution to the electroconductive support, followed by drying. Moreover, a single layer-type electrophotographic photoreceptor comprising an electron-acceptor-type compound such as an anthraquinone derivative or fluorenone derivative and the compounds of formulae (I) and (II) can be obtained in the same manner described above.

The binder used in the electrophotographic photoreceptor generally affects the mechanical strength, e.g., the adhesive strength, hardness and wear resistance of the photosensitive layer as well as the electric characteristics, e.g., the electrifiability and sensitivity of the photoreceptor. For this, not only the electric characteristics of the photoreceptor but also the durability of the photoreceptor depend on the binder to be used. The binder also affects process conditions such as the viscosity of a coating solution and the dispersion stability of the charge generating material and hence the performance of the photoreceptor is changed markedly depending on the selection of the binder. In the present invention, any of materials customarily used as binders for the photoreceptor may be used as the binder. Given as preferable examples of the binder used in the present invention are photocurable resins such as a polycarbonate resin, styrene resin, acrylic resin, styrene/acrylic resin, ethylene/vinyl acetate resin, polypropylene resin, vinyl chloride resin, chlorinated polyether resin, vinyl chloride/vinyl acetate resin, polyester resin, furan resin, nitrile resin, alkyd resin, polyacetal resin, polymethylpentene resin, polyamide resin, polyurethane resin, epoxy resin, polyacrylate resin, diacrylate resin, polysulfonic resin, polyether sulfonic resin, polyallylsulfonic resin, silicone resin, ketone resin, polyvinylbutyral resin, polyether resin, phenol resin, EVA (ethylene/vinyl acetate copolymer) resin, ABS (acrylonitrile/butadiene/styrene) resin, and epoxydiacrylate and mixtures of these compounds. Other than these insulating polymers, organic photoconductive polymers such as polyvinyl carbazole, polyvinyl anthracene and polysilane may be used.

Among these binders, a polycarbonate is a most preferable binder. Examples of the polycarbonate preferably used include bisphenolmethane type polycarbonates represented by the following general formula (A).

(A)

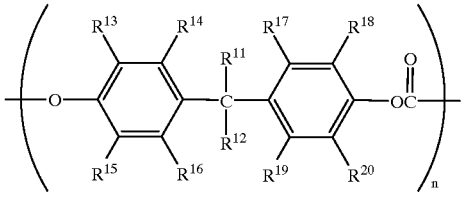

wherein $R^{11}$ and $R^{12}$, which may be the same or different, respectively represent a hydrogen atom, a lower alkyl group having 1–4 carbon atoms, a phenyl group which may be substituted with a lower alkyl group having 1–4 carbon atoms, a lower alkoxy group having 1–4 carbon atoms or a halogen group, $R^{11}$ and $R^{12}$ may be combined in a ring form, $R^{13}$, $R^{14}$, $R^{15}$, $R^{16}$, $R^{17}$, $R^{18}$, $R^{19}$ and $R^{20}$, which may be the same or different, respectively represent a hydrogen atom, a halogen atom, a lower alkyl group having 1–4 carbon atoms, a lower alkoxy group having 1–4 carbon atoms or a phenyl group which may have a substituent and n denotes an integer.

Specific and preferable examples of the polycarbonate represented by the above general formula (A) include bisphenol A-type polycarbonates represented by the general formula (A-1) shown below (for example, Yupiron E series manufactured by Mitsubishi Gas Chemical Co., Inc.), bisphenol Z-type polycarbonate resins represented by the general formula (A-2) (for instance, Polycarbonate Z series manufactured by Mitsubishi Gas Chemical Co., Inc.), polycarbonate resins represented by the general formula (A-3) or (A-4), and mixtures or copolymers of these compounds. These polycarbonates have preferably a high molecular weight to prevent the occurrences of cracks or defects when the photoreceptor is produced.

(A-1)

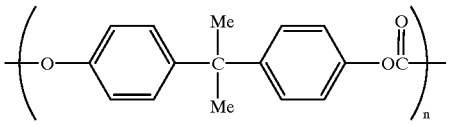

(A-2)

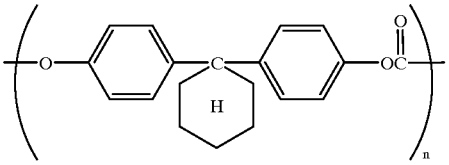

-continued (A-3)

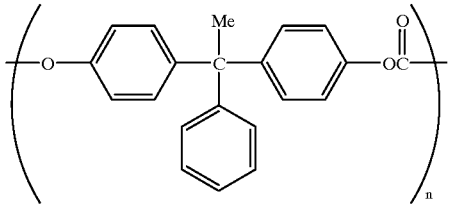

(A-4)

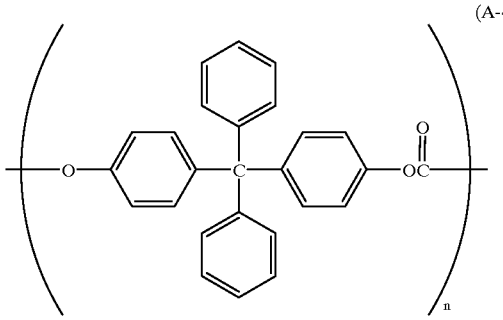

wherein n represents an integer.

As the copolymers, for example, compounds produced by optionally combining the monomer units of the general formula (A) may be used. Given as preferable examples of the copolymers are bisphenol/biphenol-type copolymer polycarbonate resins represented by the following general formula (B) which is disclosed in JP-A No. H4-179961.

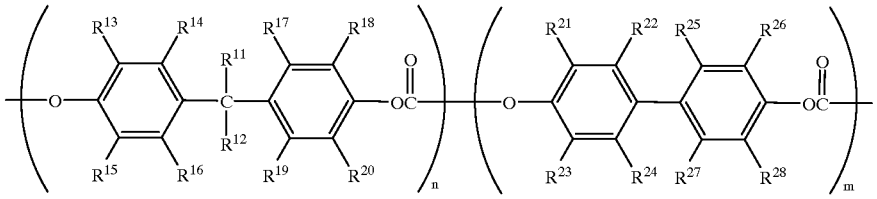

wherein $R^{11}$ and $R^{12}$, which may be the same or different, respectively represent a hydrogen atom, a lower alkyl group having 1–4 carbon atoms, a phenyl group which may be substituted with a lower alkyl group having 1–4 carbon atoms, a lower alkoxy group having 1–4 carbon atoms or a halogen group, $R^{11}$ and $R^{12}$ may be combined in a ring form, $R^{13}$, $R^{14}$, $R^{15}$, $R^{16}$, $R^{17}$, $R^{18}$, $R^{19}$ and $R^{20}$, which may be the same or different, respectively represent a hydrogen atom, a halogen atom, a lower alkyl group having 1–4 carbon atoms, a lower alkoxy group having 1–4 carbon atoms or a phenyl group which may have a substituent, $R^{21}$, $R^{22}$, $R^{23}$, $R^{24}$, $R^{25}$, $R^{26}$, $R^{27}$ and $R^{28}$, which may be the same or different, respectively represent a hydrogen atom, a halogen atom, a lower alkyl group having 1–4 carbon atoms, a lower alkoxy group having 1–4 carbon atoms or a phenyl group which may have a substituent, $R^{21}$ $R^{22}$, $R^{23}$, $R^{24}$, $R^{25}$, $R^{26}$, $R^{27}$ and $R^{28}$, may be combined respectively in a ring form and n and m denote integers.

Preferable and specific examples of the bisphenol copolymer polycarbonate include bisphenol/biphenol-type polycarbonates represented by the following general formulae (B-1), (B-2), (B-3) or (B-4). In these formulae, n and m denote integers with the ratio of n/(n+m) being preferably 0.1 to 0.9 and more preferably 0.7 to 0.9 though the ratio of n to m may be optional.

(B-1)

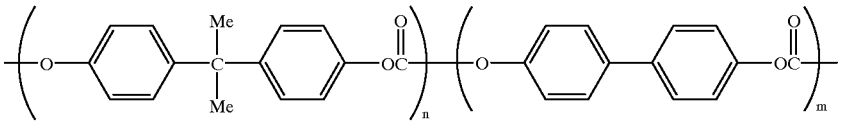

(B-2)

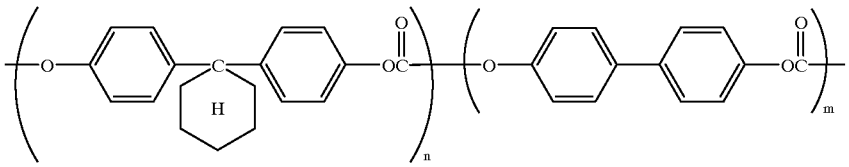

(B-3)

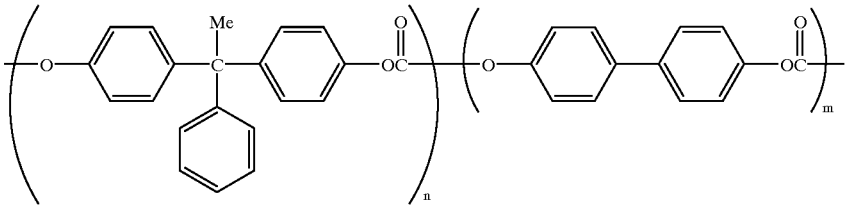

(B-4)

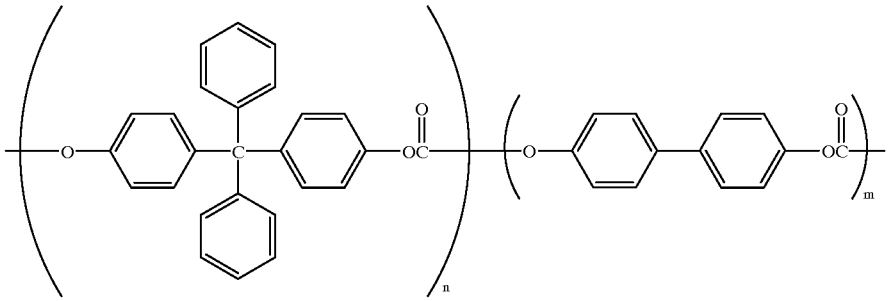

Other than the aforementioned polycarbonates, polycarbonates may be used which have a repeat unit represented by the following formula (C) and disclosed in JP-A No. H6-214412.

(C)

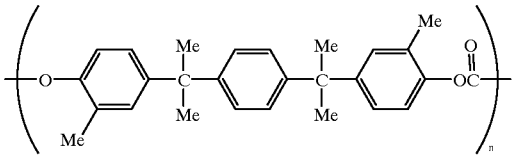

Wherein n represents an integer.

Polycarbonates may also be used which are represented by the following general formula (D) and disclosed in JP-A No. H6-222581.

(D)

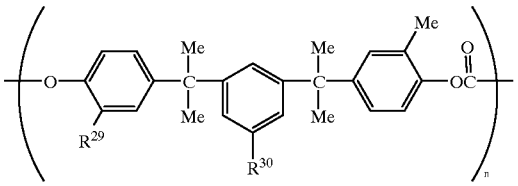

wherein $R^{29}$, $R^{30}$ and $R^{31}$, which may be the same or different, respectively represent a hydrogen atom, a halogen atom, a lower alkyl group having 1–4 carbon atoms, an alicyclic group having three to eight carbon member ring or a phenyl group which may be substituted with a lower alkyl group having 1–4 carbon atoms, a lower alkoxy group having 1–4 carbon atoms or a halogen atom or a benzyl group which may be substituted with a lower alkyl group having 1–4 carbon atoms, a lower alkoxy group having 1–4 carbon atoms or a halogen atom and n denotes an integer.

The proportion of each of these binders to the 1-(p-aminophenyl)-1,4,4-triphenylbutadiene derivative with the ratio of trans-isomer being 0.6 or more may be optional. However, the amount of the charge transfer material is generally 10 to 1000 parts by weight, preferably 30 to 500 parts by weight and more preferably 40 to 200 parts by weight based on 100 parts by weight of the binder.

The film thickness of the charge transfer layer to be formed is 2 to 40 μm, preferably 5 to 40 μm and more preferably 10 to 30 μm.

No particular limitation is imposed on the organic solvent to be used. As the organic solvent, usually alcohols such as methanol, ethanol and isopropanol, ketones such as acetone, methyl ethyl ketone and cyclohexanone, amides such as N,N-dimethylformamide and N,N-dimethylacetamide, sulfoxides such as dimethyl sulfoxide, ethers such as tetrahydrofuran, dioxane, and ethylene glycol dimethyl ether, esters such as ethyl acetate and methyl acetate, aliphatic halogenated hydrocarbons such as methylene chloride, chloroform, 1,2-dichloroethane, dichloroethylene, trichloroethylene, trichloroethane and carbon tetrachloride or aromatic compounds such as benzene, toluene, xylene, chlorobenzene and dichiorobenzene are used singly or as mixtures of these compounds.

When a charge transfer layer, a charge generating layer or a photosensitive layer consisting of a single layer is formed by application, a coating method such as a dip coating method, spray coating method, spinner coating method, wire bar coating method, blade coating method, roller coating method or curtain coating method is used as the application method. After the application, drying at room temperature at first and drying under heat next are preferably performed. The drying under heat is preferably performed usually at 30 to 200° C. for 5 minutes to 3 hours in a static or flowing air.

An electroconductive support used in the present invention may be constituted of various electroconductive materials including (i) a single metal such as aluminum, brass, stainless steel, nickel, chromium, titanium, gold, silver, copper, platinum, molybdenum, or indium or alloys of these metals, (ii) electroconductive plastic plates and films which are made by treating with electroconductive materials, for example, the above metal or carbon, by means of vapor deposition or plating, and (iii) electroconductive glasses coated with tin oxide, indium oxide or aluminum iodide without limitations to types and shapes. As the form of the electroconductive support, a drum-form, rod-form, plate-form, sheet-form or belt-form may be used.

While, as the charge generating material used in the present invention, any of materials conventionally used as charge generating materials of functional separation-type photosensitive materials may be used. Examples of such a charge generating material include inorganic charge generating materials such as selenium, selenium-tellurium and amorphous silicon and organic charge generating materials including cationic dyes such as pyrylium salt-based dyes, thiapyrylium salt-based dyes, azulenium salt-based dyes, thiacyanine-based dyes and quinocyanine-based dyes; polycyclic quinone pigments such as squalium salt-based pigments, phthalocyanine-type pigments, anthoanthrone-type pigments, dibenzpyrenequinone-type pigments and pyranthrone-type pigments; indigo-type pigments; quinacridone-type pigments; azo-type pigments; and pyrrolopyrrole-type pigments. Using at least one of these charge generating materials, it is applied by vapor deposition or it is dissolved or dispersed together with a binder in a solvent and the resulting dissolution or dispersion solution is applied to form the charge generating layer of the photographic sensitive material of the present invention.

Among the aforementioned organic charge generating materials, particularly preferable examples include organic charge generating materials described in Chem. Rev., 1993, 93, p.449–486. Among these materials, phthalocyanine-type pigments are particularly preferable. Preferable examples of the phthalocyanine-type pigment include alkoxytitanium phthalocyanine ($Ti(OR)_2Pc$), oxotitanium phthalocyanine (TiOPc), copper phthalocyanine (CuPc), Non-metal phthalocyanine ($H_2Pc$), hydroxygallium phthalocyanine (HOGaPc), vanadyl phthalocyanine (VOPc) and chloroindium phthalocyanine (ClInPc). To mention in more detail, examples of TiOPc include α-type-TiOPc, β-type-TiOPc, γ-type-TiOPc, m-type-TiOPc, Y-type-TiOPc, A-type-TiOPc, B-type-TiOPc and TiOPc amorphous. Examples of non-metal phthalocyanine ($H_2Pc$) include α-type-$H_2Pc$, β-type-$H_2Pc$, $\tau_1$-type-$H_2Pc$, $\tau_2$-type-$H_2Pc$ and χ-type-$H_2Pc$. These phthalocyanines are mixed and milled to be used as a mixed material or as a mixed crystal-type which is newly formed. Examples of the mixed crystal-type include a mixed crystal of oxotitanium phthalocyanine and vanadyl phthalocyanine as described in JP-A Nos. H4-371962, H5-2278 and H5-2279 and a mixed crystal of oxotitanium phthalocyanine and chloroindiumphthalocyanine as described in JP-A Nos. H6-271786 and H5-297617.

Also, oxotitanium phthalocyanine having the following Bragg angle (2θ±0.2 degree) in a diffraction spectrum is preferably used.

(i) Oxotitanium phthalocyanine having diffraction peaks at Bragg angles (2θ±0.2 degrees) of 7.4, 9.3, 10.6, 13.2, 15.1, 15.7, 16.1, 20.8, 23.3, 26.3 and 27.1 degrees in CuKαX-ray diffraction spectrum.

(ii) Oxotitanium phthalocyanine having diffraction peaks at Bragg angles (2θ±0.2 degree) of 9.3, 10.6, 13.2, 15.1, 16.1, 20.8, 23.3, 26.3 and 27.1 degrees in CuKαX-ray diffraction spectrum.

(iii) Oxotitanium phthalocyanine having diffraction peaks at Bragg angles (2θ±0.2 degree) of 13.6, 24.1 and 27.3 degrees in CuKαX-ray diffraction spectrum and a maximum diffraction peak at a Bragg angle of 27.3 degrees.

(iv) Oxotitanium phthalocyanine having diffraction peaks at Bragg angles (2θ±0.2 degree) of 7.5, 9.0, 10.2, 24.1, 27.1 and 28.5 degrees in CuKαX-ray diffraction spectrum and a maximum diffraction peak at a Bragg angle of 27.1 degree.

(v) Oxotitanium phthalocyanine having diffraction peaks at Bragg angles (2θ±0.2 degrees) of 7.4, 13.0, 20.5, 26.2 and 27.0 degrees in CuKαX-ray diffraction spectrum.

Examples of the azo pigment include monoazo pigments, bisazo pigments, trisazo pigments and tetrakis pigments.

As examples of the bisazo pigment, compounds represented by the following formula (A) are given.

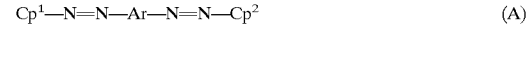

$$Cp^1—N=N—Ar—N=N—Cp^2 \quad (A)$$

wherein Ar is a group represented by the following formulae:

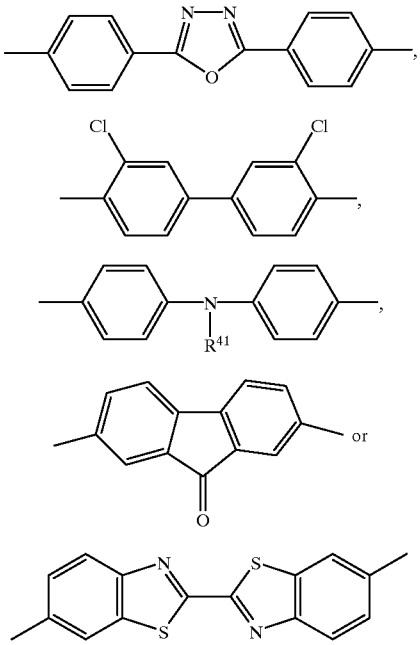

wherein $R^{41}$ represents a lower alkyl group; and $Cp^1$ and $Cp^2$ are groups represented by the following formulae respectively.

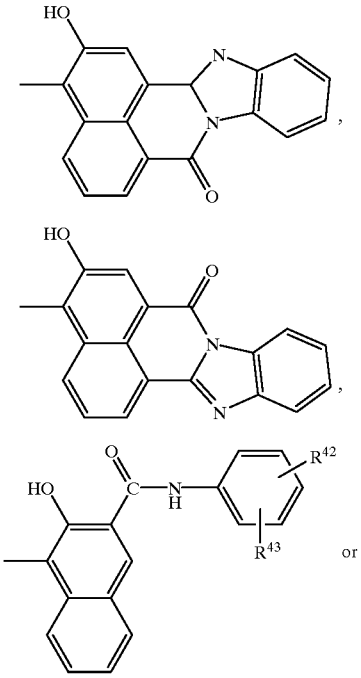

-continued

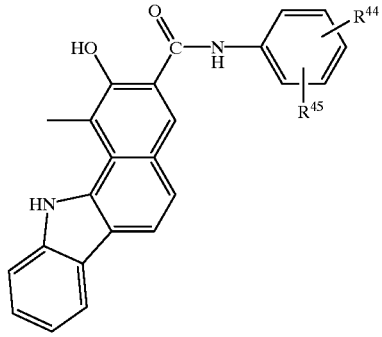

wherein $R^{42}$, $R^{43}$, $R^{44}$ and $R^{45}$, which may be the same or different, respectively represent a hydrogen atom, a halogen atom, a lower alkyl group, a lower alkoxy group, a nitro group or a cyano group.

As examples of the trisazo pigment, compounds represented by the following formula (B) are given.

(B)

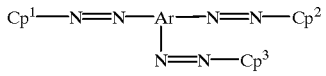

wherein Ar is a trifunctional group represented by the following formulae:

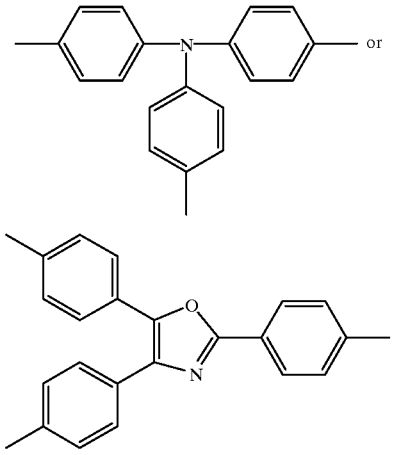

wherein $Cp^1$ and $Cp^2$ are the same as defined in the formulae (A) and $CP^3$ is the same as $Cp^1$ and $Cp^2$.

Perillene-type compounds or polycyclic quinone-type compounds represented by the following structural formulae are also preferable.

(E)

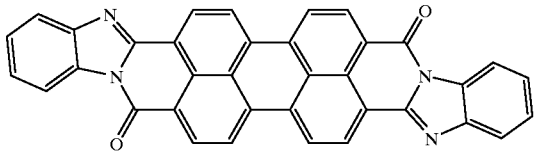

-continued (F)

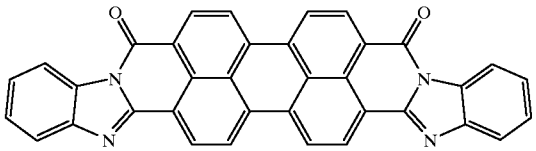

(G)

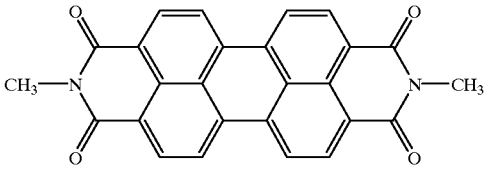

(H)

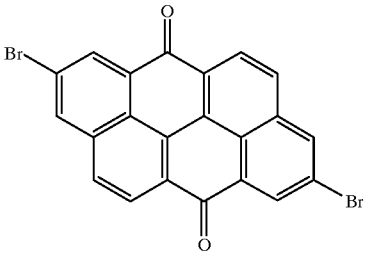

Any material other than the above materials may be used as the charge generating material of the present invention as far as it can absorb light and produce a charge efficiently.

The charge transfer layer may contain other charge transfer materials and various additives as required. As the other charge transfer materials, diamine compounds represented by the following general formula (L) are exemplified.

(L)

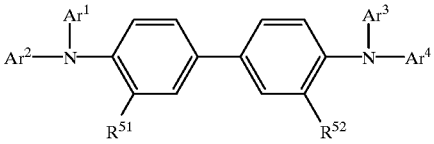

wherein $R^{51}$ and $R^{52}$, which may be the same or different, respectively represent a hydrogen atom, a halogen atom, a methyl group, a methoxy group or a phenyl group and $Ar^1$, $Ar^2$, $Ar^3$ and $Ar^4$, which may be the same or different, respectively represent an α-naphthyl group, a β-naphthyl group, a phenyl group or p-biphenyl group which may be substituted.

Among these diamines, diamines represented by the following formulae (L-1), (L-2) and (L-3) are preferable.

(L-1)

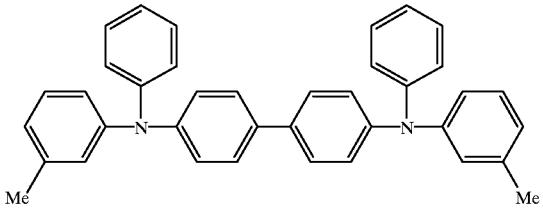

-continued (L-2)

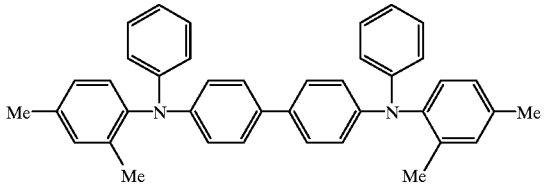

(L-3)

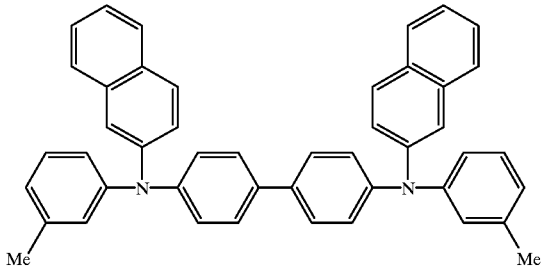

Examples of the charge transfer material, though not limited to, also include hydrazone compounds represented by the following general formula (J) which compounds are described in JP-B No. S55-42380 and JP-A Nos. S60-340999 and S61-23154; distyryl compounds represented by the following general formula (K) which compounds are described in U.S. Pat. No. 3,873,312; and, other than the above compounds, triphenylmethane derivatives, triarylamine derivatives such as N,N-diphenyl-N-biphenylamine derivatives and N,N-diphenyl-N-terphenylamine derivatives, tetraphenylbutadiene-type compounds other than the compounds represented by the general formula (1), α-phenylstilbene derivatives, and bisbutadienyltriphenylamine derivatives described in JP-A No. H7-173112.

(J)

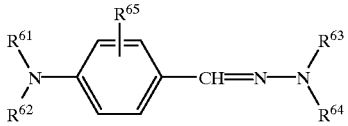

wherein $R^{61}$ and $R^{62}$, which may be the same or different, respectively represent a lower alkyl group which may have a substituent, an aryl group which may have a substituent or an alalkyl group which may have a substituent; $R^{63}$ and $R^{64}$, which may be the same or different, respectively represent a lower alkyl group which may have a substituent, an aryl group which may have a substituent, an alalkyl group which may have a substituent or a heterocyclic group which may have a substituent, $R^{63}$ and $R^{64}$ may be combined to form a ring; and $R^{65}$ represents a hydrogen atom, a lower alkyl group, an aryl group which may have a substituent, an alalkyl group which may have a substituent, a lower alkoxy group or a halogen atom and $R^{65}$ and $R^{61}$ or $R^{62}$ may be combined to form a ring.

(K)

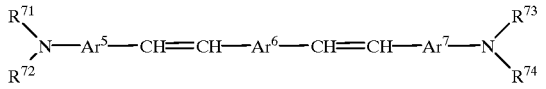

wherein $R^{71}$, $R^{72}$, $R^{73}$ and $R^{74}$, which may be the same or different, respectively represent a lower alkyl group or an aryl group which my have a substituent; $Ar^5$ and $Ar^7$, which may be the same or different, respectively represent a phenyl group which may have one or more substituents selected from the group consisting of a lower alkyl group, a lower alkoxy group, an aryloxy group and a halogen atom; $Ar^6$ represents a single- or poly-cyclic aromatic ring which may have the same substituent as in $Ar^5$ and $Ar^7$ or a hetero ring which may have the same substituent as in $Ar^5$ and $Ar^7$.

The photosensitive material of the present invention may contain a UV-ray absorber, an antioxidant and other additives as required to improve the durability thereof. In addition to the above materials, other various additives which are conventionally used to improve the characteristics of a photosensitive material may be used. Examples of these additives include plasticizers such as biphenyl-type compounds as disclosed in JP-A No. H6-332206, m-terphenyl, m-di-tert-butylphenyl and dibutylphthalate; surface lubricants such as silicone oil, graft-type silicone polymer and fluorocarbons; potential stabilizers such as dicyanovinyl compounds and carbazole derivatives; monophenol-type antioxidants such as 2-tert-butyl-4-methylphenol and 2,6-di-tert-butyl-4-methylphenol; bisphenol-type antioxidants, polymer-type phenol antioxidants, amine-type antioxidants such as 4-diazabicyclo[2,2,2]octane, salicylic acid-type antioxidants, sulfur-type antioxidants such as dilauryl-3,3'-thiodipropionate, phosphorus-type antioxidants, hindered amine-type light stabilizers such as bis(2,2,6,6-tetramethyl-4-piperidyl) sebacate and d1-tocopherol (vitamin E).

Specific examples of the antioxidants preferably used in the present invention include monophenol-type antioxidants such as 2,6-di-tert-butylphenol, 2,6-di-tert-butyl-4-methoxyphenol, 2-tert-butyl-4-methylphenol, 2-tert-butyl-4-methoxyphenol, 2,4-dimethyl-6-tert-butylphenol, 2,6-di-tert-butyl-4-methylphenol, butylated hydroxy anisole, stearyl-β-(3,5-di-tert-butyl-4-hydroxyphenyl) propionate, α-tocopherol and n-octadecyl-3-(3',5'-di-tert-butyl-4'-hydroxyphenyl)propionate and polyphenol-type antioxidants such as 2,2'-methylenebis(6-tert-butyl-4-methylphenol), 4,4'-butylidene-bis-(3-tert-butyl-4-methylphenol), 4,4'-thiobis(6-tert-butyl-3-methylphenol), 1,1,3-tris(2-methyl-4-hydroxy-5-tert-butylphenyl)butane, 1,3,5-trimethyl-2,4,6-tris(3,5-di-tert-butyl-4-hydroxybenzyl)benzene and tetrakis[methylene-3-(3,5-di-tert-butyl-4-hydroxyphenyl) propionate]methane. One or more of these compounds may be contained at the same time in the photosensitive layer.

Specific examples of the UV-ray absorber include benzotriazole types such as 2-(5-methyl-2-hydroxyphenyl) benzotriazole, 2-[2-hydroxy-3,5-bis(α,α-dimethylbenzyl) phenyl]-2H-benzotriazole, 2-(3,5-di-tert-butyl-2-hydroxyphenyl)benzotriazole, 2-(3-tert-butyl-5-methyl-2-hydroxyphenyl)-5-chlorobenzotriazole, 2-(3,5-di-tert-butyl-2-hydroxyphenyl)-5-chlorobenzotriazole, 2-(3,5-di-tert-amyl-2-hydroxyphenyl)benzotriazole and 2-(2'-hydroxy-5'-tert-octylphenyl)benzotriazole; and salicylic acid types such as phenyl salicylate, p-tert-butylphenyl salicylate and p-octylphenyl salicylate. One or more of these compounds are contained at the same time in the photosensitive layer.

An antioxidant and a UV-ray absorber may be added at the same time. Although these additives may be added to any of the layers as far as these layers exist within the photosensitive layer, these additives are preferably added to a top surface layer, particularly to a charge transfer layer.

The antioxidant is preferably added in an amount of 3 to 20% by weight based on the binding resin and the UV-ray absorber is preferably added in amount of 3 to 20% by weight based on the binding resin. When the antioxidant and the UV-ray absorber are added at the same time, the amount of both compounds is preferably 5 to 40% by weight based on the binding resin.

A base layer having a barrier function, adhesive function and function in covering defects on the surface of the support member may be formed between the photosensitive layer produced in the above manner and electroconductive support member. Examples of materials forming the base layer may include aluminum oxide, polyvinyl alcohol, nitrocellulose, casein, gelatin, ethylene-acrylic acid copolymers, polyethylene resins, acrylic resins, epoxy resins, polycarbonate resins, polyamide resins such as nylon, polyurethane resins, vinyl chloride resins, vinyl acetate resins and polyvinylbutyral resins. These compounds may be singly used or two or more of these compounds may be mixed and laminated in use. A base layer produced by dispersing a metal compound, metal oxide, carbon, silica and resin powder in a resin may also be used. Moreover, various pigments, electron-receiving materials and electron-donating materials may be contained to improve the characteristics. The film thickness of the base layer is appropriately in a range between 0.1 and 5 μm and preferably 0.5 and 3 μm.

An organic thin film of, for example, a polyvinylformal resin, polycarbonate resin, fluororesin, polyurethane resin, or silicon resin or a thin film composed of a siloxane structure made of a hydrate of a silane coupling agent may be formed to provide a surface protective layer on the surface of the photosensitive layer. This is desirable to improve the durability of the photosensitive layer. This surface protective layer may be provided to improve other functions as well as the durability.

In the manner as mentioned above, an electrophotographic photoreceptor comprising a mixture of 1-(p-aminophenyl)-1,4,4-triphenylbutadiene derivatives with the ratio of trans-isomer being 0.6 or more contained in the charge transfer layer or the single photosensitive layer can be obtained.

EXAMPLES

The invention will be explained in more detail by way of Examples which are not intended to be limiting of the present invention.

Measuring instruments and conditions used in analysis examples are shown below.

(1) $^1$H-NMR Instrument: DRX-500 model (500 MHz), manufactured by BRUKER Inc.)
Internal standard material: tetramethyl silane
Measured in bichloroform (2) MASS Instrument: Hitachi M-80B (manufactured by Hitachi Ltd.)

Synthetic Example 1

Synthesis of 1-(p-dimethylaminophenyl)-1,4,4-triphenylbutadiene (Example Compound 1)

(1) Synthesis of 3-(p-dimethylaminophenyl)-3-phenylacrolein (7a, a trans-isomer-excessive product):

10 ml of 1,2-dichloroethane and 1 ml (12.9 mmol) of N,N-dimethylformamide (DMF) were weighed and placed in a 100 ml reaction flask. To the mixture was gradually added dropwise 1.0 g (6.5 mmol) of phosphorus oxychloride while the mixture was cooled in ice-water. A bath was dismantled and the mixture was stirred for 10 minutes. Then, 5 ml of 1,2-dichloroethane containing 1.3 g (5.8 mmol) of 1-(p-dimethylaminophenyl)-1-phenylethylene (3a) which was synthesized from 4-dimethylaminobenzophenone (2a) and methylmagnesium chloride by using the method described in JP-B No. H7-21646 was added dropwise to the mixture. The resulting mixture was stirred for 3 hours at the same temperature and was then poured into water, which was then neutralized by addition of soda ash. The neutralized solution was heated at 80° C. to carry out a decomposition reaction and the resulting solution was subjected to separatory treatment. The water phase was subjected to an extraction treatment using toluene and the extract was combined with the organic phase. The resulting solution was washed with water and dried/concentrated using magnesium sulfate to obtain 1.4 g of a mixed product (6a) of a cis-isomer and a trans-isomer. The mixed product was recrystallized from a mixed solvent consisting of hexane and toluene to obtain 440 mg of 3-(p-dimethylaminophenyl)-3-phenylacrolein (7a). The yield was 29.3% and the melting point (mp) was 134–136° C. The ratio of trans-isomer measured by H-NMR was 0.98 (the ratio of trans-isomer are hereinafter indicated by a value measured by $^1$H-NMR). $^1$H-NMR (only peaks of trans-isomer are described) δ; 3.05 (s, 6H), 6.59(d, J=8.2 Hz, 1H), 6.67(d, J=9.1 Hz, 2H), 7.27(d, J=7.9 Hz, 2H), 7.47(m, 3H), 9.38(d, J=8.2 Hz, 1H). MS (m/z); 251, 234, 223, 207, 178, 165, 145, 121, 102, 91, 77, 42.

(2) Synthesis of an example compound 1

430 mg (1.7 mmol) of 3-(p-dimethylaminophenyl)-3-phenylacrolein (7a, the ratio of trans-isomer=0.98), 625 mg (2.05 mmol) of diethyl diphenylmethyl phosphonate and 10 ml of DMF were weighed and placed in a 50 ml reaction flask. To the mixture was gradually added 230 mg (2.05 mmol) of potassium t-butoxide, which was reacted at room temperature all night. The reaction mixture was poured into water and extracted using ethyl acetate. The extract was dried and concentrated using magnesium sulfate. The concentrated product was recrystallized two times from ethyl acetate to obtain 280 mg of an example compound 1 with the ratio of trans-isomer being 0.98. The yield was 40.8% and the melting point (mp) was 190–195° C. $^1$H-NMR (only peaks of trans-isomer are described) δ; 2.93(s, 6H), 6.56(d, J=9.0 Hz, 2H), 6.68(d, J=11.5 Hz, 1H), 6.72(d, J=11.5 Hz, 1H), 7.05(d, J=9.0 Hz, 2H), 7.08–7.22(m, 5H), 7.27–7.36(m, 6H), 7.36–7.42(m, 4H). MS (m/z); 402, 324, 279, 234, 211, 134, 91.

Synthetic Example 2

Synthesis of 1-(p-diethylaminophenyl)-1,4,4-triphenylbutadiene (Example Compound 8)

7.6 g (313 mmol) of magnesium, 17 ml of THF and 315 ml of toluene were weighed and placed in a 1000 ml reaction flask and were activated using iodine and dibromoethane. To the mixture was added dropwise a solution consisting of 59.0 g (233 mmol) of 4-diethylaminobenzophenone (2b), 58.4 g (256 mmol) of 3,3-diphenylallyl chloride (10a) synthesized using the method described in JP-A No. H7-173112, 16 ml of THF and 350 ml of toluene at 25–35° C. for one hour. The mixed solution was reacted at room temperature for 5 hours and the reaction solution was poured into a solution prepared by dissolving 83 g of ammonium chloride in 750 ml of water. The resulting mixture was subjected to liquid separatory treatment and the organic phase was washed. 3 g of paratoluenesulfonic acid was added in the separated organic solution and a water-removing operation was continued for 2 hours while the resulting solution was refluxed. The resulting organic phase was then neutralized/washed by addition of aqueous sodium carbonate, followed by washing, drying/concentrating using magnesium sulfate. The concentrated product was recrystallized from 120 ml of acetone and 240 ml of heptane to obtain 111 g of slightly wet crude crystals (the ratio of trans-isomer measured by $^1$H-NMR was 0.84). The crude crystals were dissolved in 350 ml of toluene. The solution was stirred together with 48 g of silica gel for one hour and was then filtered (silica gel was washed with 50 ml of toluene), followed by concentrating. The concentrated product was recrystallized from a mixed solvent of 180 ml of acetone and 370 ml of heptane to obtain 54.0 g of a crude example compound 8 (the yield from benzophenone: 54.0%, the ratio of trans-isomer by $^1$H-NMR: 0.91). 5 g of the example compound 8 was recrystallized from ethyl acetate and hexane to obtain 2.4 g of an example compound 8 with the ratio of trans-isomer being 0.99).

Data of the melting point and spectrum were as follows: mp: 131–133° C.

$^1$H-NMR (only peaks of trans-isomer are described) δ; 1.12 (t, J=7.1 Hz, 6H), 3.32(q, J=7.1 Hz, 4H), 6.52(d, J=9.0 Hz, 2H), 6.68(d, J=11.5 Hz, 1H), 6.71(d, J=11.5 Hz, 1H), 7.03(d, J=9.0 Hz, 2H), 7.11–7.25(m, 5H), 7.32–7.39(m, 6H), 7.39–7.47(m, 4H).

MS (m/z); 429, 414, 352, 294, 279, 238, 218, 194, 197, 118, 91.

While, the mother liquor from which the crude crystals were withdrawn was subjected to column chromatography (silica gel, solvent: toluene/hexane) to obtain a cis-isomer-excessive product. The product was recrystallized from ethyl acetate to obtain a comparative compound 3 with the ratio of trans-isomer being 0.01.

The melting point and the $^1$H-NMR spectrum of the comparative compound 3 are as follows:

$^1$H-NMR (only peaks of cis-isomer are described) δ; 1.20 (t, J=7.1 Hz, 6H), 3.40(q, J=7.1 Hz, 4H), 6.57(d, J=11.4 Hz, 1H), 6.67(d, J=8.8 Hz, 2H), 6.95(d, J=11.3 Hz, 1H), 7.15(d, J=8.8 Hz, 2H), 7.15–7.29(m, 10H), 7.30–7.35(m, 3H), 7.35–7.42(m, 2H).

These resulting crystals (the trans-isomer excessive crystals and the cis-isomer excessive crystals) were mixed in different ratios to prepare different samples (note: the ratio of trans-isomer: 0.8 or more) of the example compound 8 and different samples of comparative compound 3, which samples have a low ratio of trans-isomer, and these samples were used in the examples and comparative examples described later.

Synthetic Example 3

Synthesis of 1-(p-diethylaminophenyl)-1-(p-methoxyphenyl)-4,4-diphenylbutadiene (Example Compound 10)

109.2 g of an oily product was obtained from 6.0 g of magnesium, 53.5 g (189 mmol) of 4-diethylamino-4'-methoxybenzophenone (2c) and 47.4 g (207 mmol) of 3,3-diphenylallyl chloride (10a) through a Grignard reaction and a dehydration reaction in the same manner as in Synthetic Example 2. This oily product was crystallized from a mixed solvent consisting of 250 ml of isopropanol and 250 ml of ethyl acetate to obtain 64.1 g of crude crystals. The crude crystals were dissolved in 300 ml of toluene. The solution was stirred together with 40 g of silica gel for one hour and was then filtered, followed by concentrating. The concentrated product was recrystallized from a mixed solvent of hexane (150 ml) and acetone (60 ml) to obtain 35.1 g of an example compound 10 (the yield from benzophenone: 40.4%) with the trans-isomer ratio being 0.94.

Data of the melting point and spectrum were as follows: mp: 132–134° C.

$^1$H-NMR (only peaks of trans-isomer are described) δ; 1.12 (t, J=7.1 Hz, 6H), 3.31(q, J=7.1 Hz, 4H), 3.85(s, 3H), 6.52(d, J=9.0 Hz, 2H), 6.63(d, J=11.4 Hz, 1H), 6.78(d, J=11.4 Hz, 1H), 6.95(d, J=8.7 Hz, 2H), 7.04(d, J=9.0 Hz, 2H), 7.11–7.40(m, 12H).

MS (m/z): 459, 382, 224.

While, the mother liquor was concentrated and refined using silica gel column chromatography (solvent: toluene) and recrystallized twice from hexane and acetone to obtain a comparative compound 4 (mp: 123–150° C.) with the ratio of trans-isomer being 0.21.

These resulting crystals (the trans-isomer excessive crystals and the cis-isomer excessive crystals) were mixed in different ratios to prepare different samples (note: the trans-isomer ratio: 0.8 or more) of the example compound 10 and different samples of comparative compound 4, which samples have a low ratio of trans-isomer, and these samples were used in the examples and comparative examples described later.

Synthetic Example 4

Synthesis of 1-(p-diethylaminophenyl)-1-phenyl-4,4-di-(p-tolyl)butadiene (Example Compound 12)

113.6 g of an oily product was obtained from 6.0 g of magnesium, 53.0 g (209 mmol) of 4-diethylaminobenzophenone (2b) and 61.4 g (239 mmol) of 3,3-di-(p-tolyl)allyl chloride (10b) through a Grignard reaction and a dehydration reaction in the same manner as in Synthetic Example 2. This oily product was crystallized from ethyl acetate to obtain 69.0 g of crystals. The crystals were dissolved in 500 ml of toluene. The solution was stirred together with 70 g of silica gel for one hour and was then filtered, followed by concentrating. The concentrated product was crystallized twice from ethyl acetate to obtain 25.5 g of an example compound 12 (the yield from 4-diethylaminobenzophenone (2b): 26.7%) with the ratio of trans-isomer being 0.99. The melting point (mp) was 174–176° C.

$^1$H-NMR (only peaks of trans-isomer are described) δ; 1.12(t, J=7.0 Hz, 6H), 2.30(s, 3H), 2.42(s, 3H), 3.32(q, J=7.0 Hz, 4H), 6.55(d, J=9.0 Hz, 2H), 6.65(d, J=11.5 Hz, 1H), 6.71(d, J=11.5 Hz, 1H), 6.98–7.08(m, 6H), 7.20(s, 4H), 7.30–7.35(m, 3H), 7.36–7.40(m, 2H).

MS (m/z): 457, 442, 366, 229, 195.

The mother liquor was concentrated and refined using silica gel column chromatography (solvent: toluene) and recrystallized twice from hexane and acetone to obtain a comparative compound 1 (mp: 160–185° C.) with the ratio of trans-isomer being 0.14.

These resulting crystals were mixed in different ratios to prepare different samples (note: the ratio of trans-isomer: 0.8 or more) of the example compound 12 and these samples were used in the examples described later.

Synthetic Example 5

Synthesis of 1-p-di-n-propylaminophenyl)-1,4,4-triphenylbutadiene (example compound 15)

38.9 g of a crude product was obtained from 2.3 g of magnesium, 20.0 g (71.2 mmol) of 4-di-n-propylaminobenzophenone (2c) and 16.1 g (74.8 mmol) of 3,3-diphenylallyl chloride (10a) through a Grignard reaction and a successive dehydration reaction in the same manner as in Synthetic Example 2. This crude product was purified by silica gel column chromatography (solvent: toluene) and was recrystallized repeatedly from isopropanol, ethyl acetate and heptane/toluene (mixture) to obtain 11.8 g of an example compound 15 with the ratio of trans-isomer being 0.93. The yield was 36.2% and the melting point (mp) was 136–137° C.

$^1$H-NMR (only peaks of trans-isomer are described) δ; 0.90 (t, J=7.5 Hz, 6H), 1.57(sextet, J=7.5 Hz, 4H), 3.19(t, J=7.5 Hz, 4H), 6.49(d, J=9.0 Hz, 2H), 6.69(d, J=11.5 Hz, 1H), 6.72(d, J=11.5 Hz, 1H), 7.03(d, J=9.0 Hz, 2H), 7.10–7.28(m, 5H), 7.30–7.40(m, 6H), 7.40–7.45(m, 4H).

MS(m/z): 458, 428, 400, 194, 167.

The mother liquor was concentrated and recrystallized from ethyl acetate to obtain a comparative compound 5 (mp: 122.5–123.5° C.) with the ratio of trans-isomer being 0.54.

These resulting crystals were mixed in different ratios to prepare different samples (note: the ratio of trans-isomer: 0.8 or more) of the example compound 12 and these samples were used in the examples described later.

Synthetic Example 6

Synthesis of 1-(p-di-n-propylaminophenyl)-1-phenyl-4,4-di-(p-tolyl)butadiene (Example Compound 19)

27.4 g of a crude product was obtained from 1.65 g of magnesium, 14.3 g (50.8 mmol) of 4-di-n-propylaminobenzophenone (2c) and 14.35 g (55.9 mmol) of 3,3-di-(p-tolyl)allyl chloride (10b) through a Grignard reaction and a successive dehydration reaction in the same manner as in Synthetic Example 2. This crude product was crystallized from isopropanol and the crystals were dissolved in toluene. The solution was stirred together with 8.7 g of silica gel for one hour, followed by filtration. The filtrate was concentrated and recrystallized twice from toluene/heptane (mixed solvent) to obtain 13.5 g of an example compound 19 with the ratio of trans-isomer being 0.92. The yield was 54.5% and the melting point (mp) was 134–137° C. $^1$H-NMR (only peaks of trans-isomer are described) δ; 0.90 (t, J=7.5 Hz, 6H), 1.57(sextet, J=7.5 Hz, 4H), 2.28(s, 3H), 2.40(s, 3H), 3.19(t, J=7.5 Hz, 4H), 6.49(d, J=9.0 Hz, 2H), 6.65(d, J=11.5 Hz, 1H), 6.70(d, J=11.5 Hz, 1H), 6.98–7.08(m, 6H), 7.20(s, 4H), 7.30–7.35(m, 3H), 7.36–7.40(m, 2H).

MS (m/z): 485, 456, 428, 294, 242, 195, 105.

The mother liquor was concentrated and recrystallized from ethyl acetate to obtain a comparative compound 6 (mp: 128–130° C.) with the ratio of trans-isomer being 0.37.

These resulting crystals were mixed in different ratios to prepare different samples (note: the trans-isomer ratio: 0.8 or more) of the example compound 19 and these samples were used in the examples described later.

Example 1

One part by weight of a butyral resin (Polyvinyl Butyral BL-1, manufactured by Sekisui Chemical Co., Ltd.) was dissolved in 30 parts by weight of tetrahydrofuran to prepare a binder resin solution, to which was added one part by weight of α-type-oxotitanium phthalocyanine (α-TiOPc, manufactured by Sanyo Shikiso Kabushiki Kaisha) and the mixture was dispersed using glass beads in a vibration mill for 5 hours. The dispersed solution was applied, using a wire bar, onto a sheet produced by depositing aluminum on a polyethylene terephthalate (PET) film and was dried to form a charge generating layer.

One part by weight of example compound 8 (the ratio of trans-isomer: 0.91) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer using a doctor blade and was dried at 80° C. for 3 hours to produce a photosensitive layer.

The photoreceptor prepared in this manner was measured for its electrophotographic characteristics by a static method using an electrostatic recording test machine EPA-8200 model (manufactured by Kawaguchi Denki Seisakusho). Specifically, the photosensitive material was charged by means of −6 kV corona discharge to measure the surface potential $V_0$ (unit: -v) and was kept in a dark place for 5 seconds (the surface potential: $V_i$ (unit: -v)). The photosensitive material was then irradiated with light at an intensity of 5 lux from a halogen lamp to measure the half potential exposure $E_{1/2}$, (lux·second) namely, an exposure value required to reduce the surface potential $V_i$ by half and the exposure $E_{1/6}$ required to reduce the surface potential $V_i$ to one-sixth and, in succession, the surface residual potential $V_{R10}$ (-v) after light was applied at an intensity of 5 lux for 10 seconds were measured. The results are shown in Table 2.

Examples 2 to 4

A charge generating layer was formed using α-type oxotitanium phthalocyanine in the same manner as in Example 1.

While, as shown in Table 2, one part by weight of each of the example compound 10 (the ratio of trans-isomer: 0.80), the example compound 15 (the ratio of trans-isomer: 0.93) or the example compound 19 (the ratio of trans-isomer: 0.92) and one part by weight of a bisphenol A/biphenol-type copolymer polycarbonate resin (manufactured by Idemitsu Kosan Co., Ltd.) shown by the structural formula (B-1) or one part by weight of a polycarbonate resin (Polycarbonate Z-200, manufactured by Mitsubishi Gas Chemical Inc.) were mixed with and dissolved in 8 parts by weight of dichloroethane. Each of these solutions was applied onto the above charge generating layer by using a doctor blade and was dried at 80° C. for 3 hours to produce a photosensitive layer.

Each of these photoreceptor prepared in this manner was measured for its electrophotographic characteristics in the same manner as in Example 1. The results are shown in Table 2.

Example 5

A charge generating layer was formed using α-type oxotitanium phthalocyanine in the same manner as in Example 1.

While, as shown in Table 2, 0.5 parts by weight of the example compound 8 (the ratio of trans-isomer: 0.91), 0.5 parts by weight of the compound (a) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

(a)

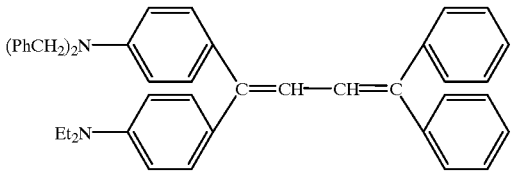

This photosensitive materials prepared in this manner was measured for its electrophotographic characteristics in the same manner as in Example 1. The results are shown in Table 2.

Comparative Example 1

A charge generating layer was formed using α-type oxotitanium phthalocyanine in the same manner as in Example 1.

While, one part by weight of the comparative compound 1 (the ratio of trans-isomer: 0.14) which had the same structure as that of the example compound 12 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved and hence the electrophotographic characteristics could not be measured.

TABLE 2

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 1 | Ex. compound 8 (ratio of trans-isomer: 0.91) | Poly-carbonate (B-1) | α-TiOPc | 943 | 770 | 0 | 0.48 | 0.84 |
| Ex. 2 | Ex. compound 10 (ratio of trans-isomer: 0.80) | Poly-carbonate (B-1) | α-TiOPc | 915 | 754 | 1 | 0.54 | 1.04 |
| Ex. 3 | Ex. compound 15 (ratio of trans-isomer: 0.93) | Poly-carbonate (A-2) | α-TiOPc | 869 | 695 | 0 | 0.48 | 0.97 |
| Ex. 4 | Ex. compound 19 (ratio of trans-isomer: 0.92) | Poly-carbonate (B-1) | α-TiOPc | 999 | 813 | 0 | 0.51 | 0.95 |

TABLE 2-continued

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 5 | Ex. compound 8 (ratio of trans-isomer: 0.91) (0.5 parts by weight) Compound (a) (0.5 parts by weight) | Poly-carbonate (B-1) | α-TiOPc | 1003 | 793 | 4 | 0.54 | 0.99 |
| Comp. Ex. 1 | Comp. Compound 1 (the same structural formula as the ex. Comp. 12, ratio of trans-isomer: 0.14) | Poly-carbonate (B-1) | α-TiOPc | * | | | | |

*Not dissolved in the polymer binder

Example 6

One part by weight of a butyral resin (Polyvinyl Butyral BL-1, manufactured by Sekisui Chemical Co., Ltd.) was dissolved in 30 parts by weight of tetrahydrofuran to prepare a binder resin solution, to which was added one part by weight of β-type-oxotitanium phthalocyanine (β-TiOPc, manufactured by Sanyo Shikiso kabushiki Kaisha) and the mixture was dispersed using glass beads in a vibration mill for 5 hours. The dispersed solution was applied, using a wire bar, onto a sheet produced by depositing aluminum on a polyethylene terephthalate (PET) film and was dried to form a charge generating layer.

While, one part by weight of the example compound 8 (the trans-isomer ratio: 0.86) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 3.

Examples 7 and 8

A charge generating layer was formed using β-type oxotitanium phthalocyanine in the same manner as in Example 6.

While, as shown in Table 3, one part by weight of each of the example compound 8 (the ratio of trans-isomer: 0.91) and the example compound 19 (the ratio of trans-isomer: 0.82) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. Each of these solutions was applied onto the above charge generating layer by using a doctor blade and was dried at 80° C. for 3 hours to produce a photosensitive layer.

Each of these photoreceptor prepared in this manner was measured for its electrophotographic characteristics in the same manner as in Example 1. The results are shown in Table 3.

Example 9

A charge generating layer was formed using β-type oxytitanylphthalocyanine in the same manner as in Example 6.

While, as shown in Table 3, 0.5 parts by weight of the example compound 8 (the ratio of trans-isomer: 0.83), 0.5 parts by weight of the compound (b) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

(b)

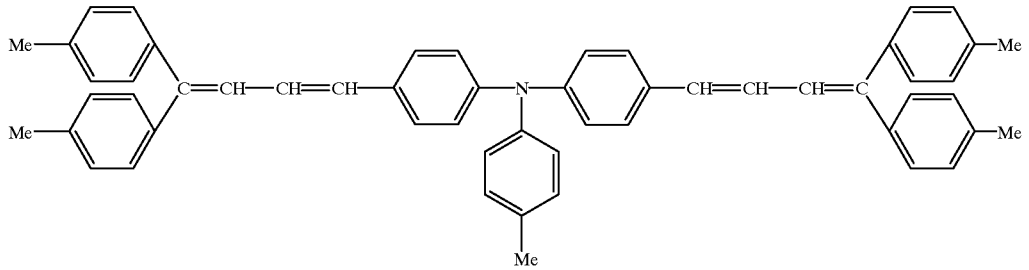

The photoreceptor prepared in this manner was measured for its electrophotographic characteristics in the same manner as in Example 1. The results are shown in Table 3.

Comparative Example 2

A charge generating layer was formed using β-type oxotitanium phthalocyanine in the same manner as in Example 6.

While, one part by weight of the comparative compound 1 (the trans-isomer ratio: 0.14) which had the same structure as that of the example compound 12 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved in the resin and hence the electrophotographic characteristics could not be measured.

Comparative Example 3

A charge generating layer was formed using β-type oxotitanium phthalocyanine in the same manner as in Example 6.

While, one part by weight of the comparative compound 2 shown by the formula shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

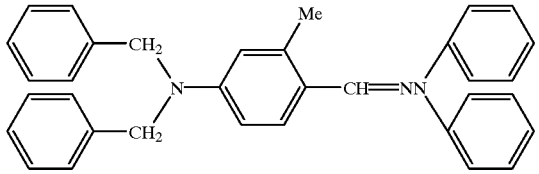

The elecrophotographic photoreceptor prepared in this manner was measured for its electrophotographic characteristics in the same manner as in Example 1. The results are shown in Table 3.

TABLE 3

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 6 | Ex. compound 8 (ratio of trans-isomer: 0.86) | Poly-carbonate (B-1) | β-TiOPc | 943 | 788 | 8 | 0.98 | 3.29 |
| Ex. 7 | Ex. compound 15 (ratio of trans-isomer: 0.91) | Poly-carbonate (B-1) | β-TiOPc | 751 | 541 | 0 | 0.85 | 2.09 |
| Ex. 8 | Ex. compound 19 (ratio of trans-isomer: 0.82) | Poly-carbonate (B-1) | β-TiOPc | 792 | 564 | 0 | 1.16 | 2.84 |
| Ex. 9 | Ex. compound 8 (ratio of trans-isomer: 0.83) (0.5 parts by weight) Compound (b) (0.5 parts by weight) | Poly-carbonate (B-1) | β-TiOPc | 717 | 555 | 0 | 1.10 | 2.60 |
| Comp. Ex. 2 | Comparative compound 1 (the same structural formula as the | Poly-carbonate (B-1) | β-TiOPc | * | | | | |

TABLE 3-continued

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| | ex. comp. 12, ratio of trans-isomer: 0.14) | | | | | | | |
| Comp. Ex. 3 | Comparative compound 2, | Poly-carbonate (B-1) | β-TiOPc | 619 | 370 | 21 | 1.32 | 8.03 |

*Not dissolved in the polymer binder

As is clear from Table 3, it is understood that the electrophotographic photoreceptor comprising the example compounds has a sensitivity higher (the values of $E_{1/2}$ and $E_{1/6}$ are smaller) and a residual potential ($V_{R10}$) lower than those comprising the comparative compounds.

Example 10

Figure 2:
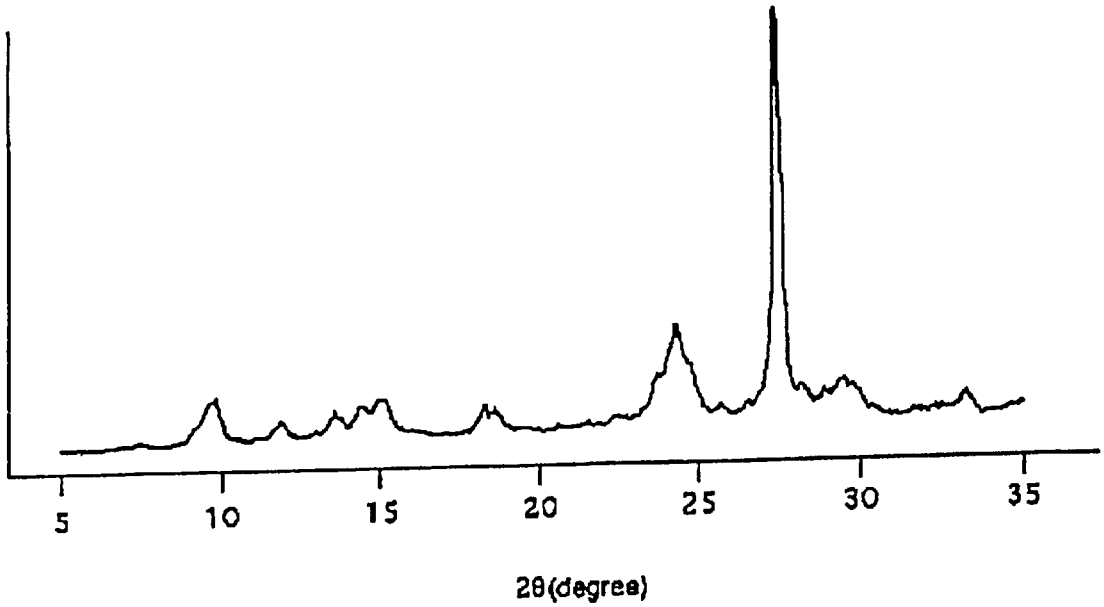
FIG. 2 is an X-ray diffraction analysis diagram of a crystalline oxotitanium phthalocyanine manufactured by ZENECA LTD.

One part by weight of a butyral resin (Polyvinyl Butyral BL-1, manufactured by Sekisui Chemical Co., Ltd.) was dissolved in 30 parts by weight of tetrahydrofuran to prepare a binder resin solution, to which was added one part by weight of crystalline oxotitanium phthalocyanine (crystalline TiOPc (1) which was analyzed by X-ray diffraction as shown in FIG. 2, manufactured by ZENECA LTD.) and the mixture was dispersed using glass beads in a vibration mill for 5 hours. The dispersed solution was applied, using a wire bar, onto a sheet produced by depositing aluminum on a polyethylene terephthalate (PET) film and was dried to form a charge generating layer.

While, one part by weight of the example compound 8 (the trans-isomer ratio: 0.83) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 4.

Examples 11 to 13

A charge generating layer was formed using crystalline oxotitanium phthalocyanine (crystalline TiOPc (1)) manufactured by ZENECA LTD. in the same manner as in Example 10.

While, as shown in Table 4, one part by weight of each of the example compound 10 (the trans-isomer ratio: 0.89), example compound 15 (the trans-isomer ratio: 0.89) and the example compound 19 (the trans-isomer ratio: 0.85) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. Each of these solutions was applied onto the above charge generating layer by using a doctor blade and was dried at 80° C. for 3 hours to produce a photosensitive layer.

Each of these photoreceptor prepared in this manner was measured for its electrophotographic characteristics in the same manner as in Example 1. The results are shown in Table 4.

Example 14

A charge generating layer was formed using crystalline oxotitanium phthalocyanine (crystalline TiOPc (1)) manufactured by ZENECA LTD. in the same manner as in Example 10.

While, as shown in Table 4, 0.5 parts by weight of the example compound 15 (the ratio of trans-isomer: 0.93), 0.5 parts by weight of the compound (c) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

(c)

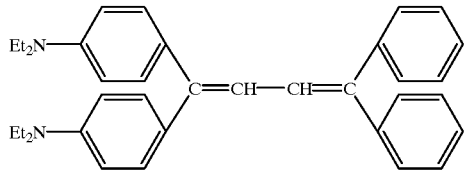

The photoreceptor prepared in this manner was measured for its electrophotographic characteristics in the same manner as in Example 1. The results are shown in Table 4.

Comparative Example 4

A charge generating layer was formed using crystalline oxotitanium phthalocyanine (TiOPc (1)) manufactured by ZENECA LTD. in the same manner as in Example 10.

While, one part by weight of the comparative compound 1 (the trans-isomer ratio: 0.14) which had the same structure as that of the example compound 12 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved and hence the electrophotographic characteristics could not be measured.

Comparative Example 5

A charge generating layer was formed using crystalline oxotitanium phthalocyanine (TiOPc (1)) in the same manner as in Example 10.

While, one part by weight of the comparative compound 2 and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 4.

While, one part by weight of the example compound 8 (the trans-isomer ratio: 0.99) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 5.

Examples 16 to 18

A charge generating layer was formed using crystalline oxotitanium phthalocyanine (crystalline TiOPc (2)) described in JP-A No. H2-28265 in the same manner as in Example 15.

TABLE 4

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 10 | Ex. compound 8 (ratio of trans-isomer: 0.83) | Poly-carbonate (B-1) | Crystalline TiOPc(1) | 697 | 541 | 0 | 0.29 | 0.51 |
| Ex. 11 | Ex. compound 10 (ratio of trans-isomer: 0.89) | Poly-carbonate (B-1) | Crystalline TiOPc(1) | 655 | 500 | 0 | 0.30 | 0.67 |
| Ex. 12 | Ex. compound 15 (ratio of trans-isomer: 0.89) | Poly-carbonate (B-1) | Crystalline TiOPc(1) | 768 | 581 | 0 | 0.33 | 0.69 |
| Ex. 13 | Ex. compound 19 (ratio of trans-isomer: 0.85) | Poly-carbonate (B-1) | Crystalline TiOPc(1) | 759 | 603 | 0 | 0.30 | 0.61 |
| Ex. 14 | Ex. compound 15 (ratio of trans-isomer: 0.93) (0.5 parts by weight) Compound (c) (0.5 parts by weight) | Poly-carbonate (B-1) | Crystalline TiOPc(1) | 694 | 511 | 0 | 0.35 | 0.69 |
| Comp. Ex. 4 | Comparative Compound 1 (the same structural formula as the ex. Comp. 12, ratio of trans-isomer: 0.14) | Poly-carbonate (B-1) | Crystalline TiOPc(1) | * | | | | |
| Comp. Ex. 5 | Comparative Compound 2, | Poly-carbonate (B-1) | Crystalline TiOPc(1) | 774 | 604 | 12 | 0.40 | 0.90 |

*Not dissolved in the polymer binder

As is clear from Table 4, it is understood that the photoreceptor using the example compounds have a sensitivity higher (the values of $E_{1/2}$ and $E_{1/6}$ are smaller) and a residual potential ($V_{R10}$) lower than those using the comparative compounds.

Example 15

Oxotitanium phthalocyanine (crystalline TiOPc (2)) described in JP-A No. H2-28265 was used together with polyvinyl butyral and THF to prepare a dispersion solution according to the method described in the above laying open patent application. The dispersed solution was applied, using a wire bar, onto a sheet produced by depositing aluminum on a polyethylene terephthalate (PET) film and was dried to form a charge generating layer.

While, as shown in Table 5, one part by weight of each of the example compound 10 (the ratio of trans-isomer: 0.85), example compound 12 (the trans-isomer ratio: 0.84) and the example compound 15 (the ratio of trans-isomer: 0.87) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. Each of these solutions was applied onto the above charge generating layer by using a doctor blade and was dried at 80° C. for 3 hours to produce a photosensitive layer.

Each of these photoreceptors prepared in this manner was measured for its electrophotographic characteristics in the same manner as in Example 1. The results are shown in Table 5.

Example 19

A charge generating layer was formed using crystalline oxotitanium phthalocyanine (crystalline TiOPc (2)) described in JP-A No. H2-28265 in the same manner as in Example 15.

While, as shown in Table 5, 0.5 parts by weight of the example compound 15 (the ratio of trans-isomer: 0.84), 0.5 parts by weight of the compound (d) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

(d)

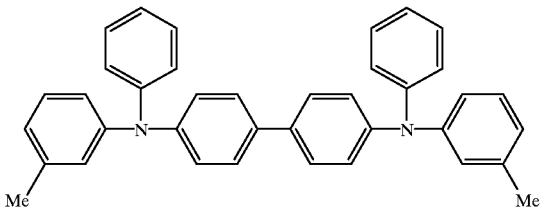

The photoreceptor prepared in this manner was measured for its electrophotographic characteristics in the same manner as in Example 1. The results are shown in Table 5.

Comparative Example 6

A charge generating layer was formed using crystalline oxotitanium phthalocyanine (TiOPc (2)) in the same manner as in Example 15.

While, one part by weight of the comparative compound 1 (the ratio of trans-isomer: 0.14) which had the same structure as that of the example compound 12 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved and hence the electrophotographic characteristics could not be measured.

Comparative Example 7

A charge generating layer was formed using crystalline oxotitanium phthalocyanine (TiOPc (2)) in the same manner as in Example 15.

While, one part by weight of the comparative compound 2 and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 5.

Comparative Example 8

A charge generating layer was formed using crystalline oxotitanium phthalocyanine (TiOPc (2)) in the same manner as in Example 15.

While, one part by weight of the comparative compound 3 (the trans-isomer ratio: 0.01) which had the same structure as that of the example compound 8 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 5.

TABLE 5

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 15 | Ex. compound 8 (ratio of trans-isomer: 0.99) | Poly-carbonate (B-1) | Crystalline TiOPc(2) | 969 | 816 | 0 | 0.29 | 0.79 |
| Ex. 16 | Ex. compound 10 (ratio of trans-isomer: 0.85) | Poly-carbonate (B-1) | Crystalline TiOPc(2) | 705 | 584 | 1 | 0.58 | 1.66 |
| Ex. 17 | Ex. compound 12 (ratio of trans-isomer: 0.84) | Poly-carbonate (B-1) | Crystalline TiOPc(2) | 967 | 844 | 0 | 0.43 | 0.89 |
| Ex. 18 | Ex. compound 15 (ratio of trans-isomer: 0.87) | Poly-carbonate (B-1) | Crystalline TiOPc(2) | 856 | 742 | 0 | 0.32 | 0.70 |
| Ex. 19 | Ex. compound 15 (ratio of trans-isomer 0.84) (0.5 parts by weight) Compound (d) (0.5 parts by | Poly-carbonate (B-1) | Crystalline TiOPc(2) | 843 | 729 | 8 | 0.45 | 0.96 |

TABLE 5-continued

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| | weight) | | | | | | | |
| Comp. Ex. 6 | Comparative compound 1 (the same structural formula as the ex. comp. 12, ratio of trans-isomer: 0.14 | Poly-carbonate (B-1) | Crystalline TiOPc(2) | * | | | | |
| Comp. Ex. 7 | Comparative compound 2 | Poly-carbonate (B-1) | Crystalline TiOPc(2) | 787 | 678 | 15 | 0.85 | 2.01 |
| Comp. Ex. 8 | Comparative compound 3 (ratio of trans-isomer: 0.01) | Poly-carbonate (B-1) | Crystalline TiOPc(2) | 1002 | 880 | 43 | 0.76 | 1.94 |

*Not dissolved in the polymer binder

As is clear from Table 5, it is understood that the electrophotographic photoreceptor comprising the example compounds have a sensitivity higher (the values of $E_{1/2}$ and $E_{1/6}$ are smaller) and a residual potential ($V_{R10}$) lower than those comprising the comparative compounds.

Example 20

One part by weight of a butyral resin (Polyvinyl Butyral BL-1, manufactured by Sekisui Chemical Co., Ltd.) was dissolved in 30 parts by weight of tetrahydrofuran to prepare a binder resin solution, to which was added one part by weight of oxotitanium phthalocyanine (crystalline TioPc (3)) prepared according to the method described in JP-A No. H1-291256 and the mixture was dispersed using glass beads in a vibration mill for 5 hours. The dispersed solution was applied, using a wire bar, onto a sheet produced by depositing aluminum on a polyethylene terephthalate (PET) film and was dried to form a charge generating layer.

While, one part by weight of the example compound 8 (the ratio of trans-isomer: 0.92) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 6.

Examples 21 to 23

A charge generating layer was formed using crystalline oxotitanium phthalocyanine (crystalline TiOPc (3)) described in JP-A No. H1-291256 in the same manner as in Example 20.

While, as shown in Table 6, one part by weight of each of the example compound 10 (the ratio of trans-isomer: 0.91), example compound 12 (the ratio of trans-isomer: 0.80) and the example compound 15 (the ratio of trans-isomer: 0.86) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. Each of these solutions was applied onto the above charge generating layer by using a doctor blade and was dried at 80° C. for 3 hours to produce a photosensitive layer.

Each of these photoreceptors prepared in this manner was measured for its electrophotographic characteristics in the same manner as in Example 1. The results are shown in Table 6.

Example 24

A charge generating layer was formed using crystalline oxotitanium phthalocyanine (crystalline TiOPc (3)) described in JP-A No. H1-291256 in the same manner as in Example 20.

While, as shown in Table 6, 0.8 parts by weight of the example compound 19 (the ratio of trans-isomer: 0.92), 0.2 parts by weight of the compound (e) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

(e)

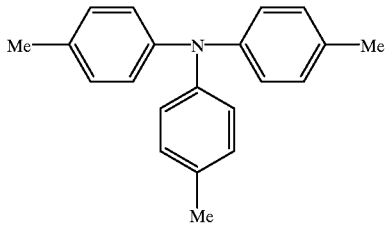

The photoreceptor prepared in this manner was measured for its electrophotographic characteristics in the same manner as in Example 1. The results are shown in Table 6.

Comparative Example 9

A charge generating layer was formed using crystalline oxotitanium phthalocyanine (TiOPc (3)) in the same manner as in Example 20.

While, one part by weight of the comparative compound 1 (the trans-isomer ratio: 0.14) which had the same structure as that of the example compound 12 but a lower trans-isomer ratio and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved and hence the electrophotographic characteristics could not be measured.

Comparative Example 10

A charge generating layer was formed using crystalline oxotitanium phthalocyanine (TiOPc (3)) in the same manner as in Example 20.

While, one part by weight of the comparative compound 2 and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 6.

Comparative Example 11

A charge generating layer was formed using crystalline oxotitanium phthalocyanine (TiOPc (3)) in the same manner as in Example 20.

While, one part by weight of the comparative compound 3 (the trans-isomer ratio: 0.01) which had the same structure as that of the example compound 8 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 6.

TABLE 6

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 20 | Ex. compound 8 (ratio of trans-isomer: 0.92) | Poly-carbonate (B-1) | Crystalline TiOPc(3) | 879 | 528 | 0 | 0.43 | 0.99 |
| Ex. 21 | Ex. compound 10 (ratio of trans-isomer: 0.91) | Poly-carbonate (B-1) | Crystalline TiOPc(3) | 786 | 566 | 0 | 0.51 | 1.20 |
| Ex. 22 | Ex. compound 12 (ratio of trans-isomer: 0.80) | Poly-carbonate (B-1) | Crystalline TiOPc(3) | 825 | 649 | 0 | 0.51 | 1.11 |
| Ex. 23 | Ex. compound 15 (ratio of trans-isomer: 0.86) | Poly-carbonate (B-1) | Crystalline TiOPc(3) | 915 | 668 | 0 | 0.49 | 1.05 |
| Ex. 24 | Ex. compound 19 (ratio of trans-isomer: 0.92) (0.8 parts by weight) Compound (e) (0.2 parts by weight) | Poly-carbonate (B-1) | Crystalline TiOPc(3) | 784 | 596 | 0 | 0.61 | 1.34 |
| Comp. Ex. 9 | Comparative compound 1 (the same structural formula as the ex. comp. 12, ratio of trans-isomer: 0.14) | Poly-carbonate (B-1) | Crystalline TiOPc(3) | * | | | | |
| Comp. Ex. 10 | Comparative compound 2 | Poly-carbonate (B-1) | Crystalline TiOPc(3) | 921 | 702 | 21 | 0.52 | 1.35 |
| Comp. Ex. 11 | Comparative compound 3 (ratio of trans-isomer: 0.01) | Poly-carbonate (B-1) | Crystalline TiOPc(3) | 1026 | 793 | 37 | 0.85 | 3.52 |

*Not dissolved in the polymer binder

As is clear from Table 6, it is understood that the electrophotographic sensitive materials using the example compounds have a sensitivity higher (the values of $E_{1/2}$ and $E_{1/6}$ are smaller) and a residual potential ($V_{R10}$) lower than those using the comparative compounds.

Example 25

One part by weight of a butyral resin (Polyvinyl Butyral BL-1, manufactured by Sekisui Chemical Co., Ltd.) was dissolved in 30 parts by weight of tetrahydrofuran to prepare a binder resin solution, to which was added one part by weight of τ-type non-metal phthalocyanine (τ-$H_2$Pc) and the mixture was dispersed using glass beads in a vibration mill for 5 hours. The dispersed solution was applied, using a wire bar, onto a sheet produced by depositing aluminum on a polyethylene terephthalate (PET) film and was dried to form a charge generating layer.

While, one part by weight of the example compound 12 (the ratio of trans-isomer: 0.99) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 7.

Example 26

A charge generating layer was formed using τ-type non-metal phthalocyanine (τ-$H_2$Pc) in the same manner as in Example 25.

While, as shown in Table 7, one part by weight of the example compound 15 (the ratio of trans-isomer: 0.85) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 7.

Example 27

A charge generating layer was formed using τ-type non-metal phthalocyanine (τ-$H_2$Pc) in the same manner as in Example 25.

While, as shown in Table 7, 0.5 parts by weight of the example compound 10 (the ratio of trans-isomer: 0.94), 0.5 parts by weight of the compound (f) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

(f)

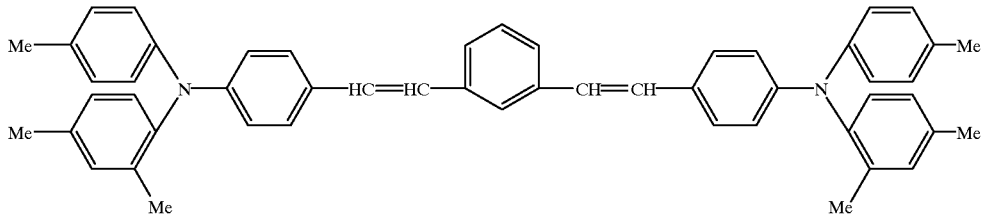

The photoreceptor prepared in this manner was measured for its electrophotographic characteristics in the same manner as in Example 1. The results are shown in Table 7.

Comparative Example 12

A charge generating layer was formed using τ-type non-metal phthalocyanine (τ-$H_2$PC) in the same manner as in Example 25.

While, one part by weight of the comparative compound 1 (the ratio of trans-isomer: 0.14) which had the same structure as that of the example compound 12 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved and hence the electrophotographic characteristics could not be measured.

Comparative Example 13

A charge generating layer was formed using τ-type non-metal phthalocyanine (τ-$H_2$Pc) in the same manner as in Example 25.

While, one part by weight of the comparative compound 3 (the ratio of trans-isomer: 0.01) which had the same structure as that of the example compound 8 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 7.

TABLE 7

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 25 | Ex. compound 12 (ratio of trans-isomer: 0.99) | Poly-carbonate (B-1) | τ-$H_2$Pc | 1156 | 1022 | 1 | 0.82 | 1.54 |
| Ex. 26 | Ex. compound 15 (ratio of trans-isomer: 0.85) | Poly-carbonate (B-1) | τ-$H_2$Pc | 717 | 464 | 4 | 0.80 | 1.61 |
| Ex. 27 | Ex. compound 10 (ratio of trans-isomer: 0.94) (0.5 parts by weight) Compound (f) (0.5 parts by eight) | Poly-carbonate (B-1) | τ-$H_2$Pc | 840 | 589 | 11 | 1.15 | 2.69 |
| Comp. Ex. 12 | Comparative compound 1 (the same structural formula as the ex. comp. 12, ratio of trans-isomer: 0.14) | Poly-carbonate (B-1) | τ-$H_2$Pc | * | | | | |
| Comp. Ex. 13 | Comparative compound 3 (ratio of trans-isomer: 0.01) | Poly-carbonate (B-1) | τ-$H_2$Pc | 1026 | 793 | 37 | 0.85 | 3.52 |

*Not dissolved in the polymer binder

As is clear from Table 7, it is understood that the electrophotographic photoreceptor comprising the example compounds have a sensitivity higher (the values of $E_{1/2}$ and $E_{1/6}$ are smaller) and a residual potential ($V_{R10}$) lower than those comprising the comparative compounds.

Example 28

One part by weight of a butyral resin (Polyvinyl Butyral BL-1, manufactured by Sekisui Chemical Co., Ltd.) was dissolved in 30 parts by weight of tetrahydrofuran to prepare a binder resin solution, to which was added one part by weight of χ-type non-metal phthalocyanine (χ-$H_2$Pc) and the mixture was dispersed using glass beads in a vibration mill for 5 hours. The dispersed solution was applied, using a wire bar, onto a sheet produced by depositing aluminum on a polyethylene terephthalate (PET) film and was dried to form a charge generating layer.

While, one part by weight of the example compound 8 (the ratio of trans-isomer: 0.92) and one part by weight of Polycarbonate Z-200 (manufactured by Mitsubishi Gas Chemical Inc.) shown by the structural formula (A-2) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 8.

Examples 29–31

A charge generating layer was formed using χ-type non-metal phthalocyanine (χ-$H_2$PC) in the same manner as in Example 28.

While, as shown in Table 8, one part by weight of each of the example compound 10 (the ratio of trans-isomer: 0.94), example compound 15 (the ratio of trans-isomer: 0.84) and the example compound 19 (the ratio of trans-isomer: 0.88) and one part by weight of a bisphenol A/biphenol-type copolymer polycarbonate resin (manufactured by Idemitsu Kosan Co., Ltd.) shown by the structural formula (B-1) or one part by weight of a polycarbonate resin (Polycarbonate Z-200, manufactured by Mitsubishi Gas Chemical Inc.) shown by the structural formula (A-2) were mixed with and dissolved in 8 parts by weight of dichloroethane. Each of these solutions was applied onto the above charge generating layer by using a doctor blade and was dried at 80° C. for 3 hours to produce a photosensitive layer.

Each of these photoreceptor prepared in this manner was measured for its electrophotographic characteristics in the same manner as in Example 1. The results are shown in Table 8.

Example 32

A charge generating layer was formed using χ-type non-metal phthalocyanine (χ-$H_2$Pc) in the same manner as in Example 28.

While, as shown in Table 8, 0.75 parts by weight of the example compound 8 (the ratio of trans-isomer: 0.91), 0.25 parts by weight of the compound (g) shown below and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The solution was applied onto the above charge generating layer by using a doctor blade and was dried at 80° C. for 3 hours to produce a photosensitive layer.

(g)

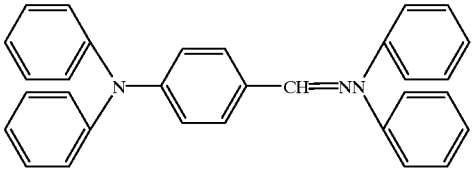

The photoreceptor prepared in this manner was measured for its electrophotographic characteristics in the same manner as in Example 1. The results are shown in Table 8.

Comparative Example 14

A charge generating layer as formed using χ-type non-metal phthalocyanine (χ-$H_2$PC) in the same manner as in Example 28.

Comparative Example 15

A charge generating layer was formed using χ-type non-metal phthalocyanine (χ-$H_2$Pc) in the same manner as in Example 28.

While, one part by weight of the comparative compound 2 and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. This solution was applied onto the above charge generating layer by using a doctor blade and was dried at 80° C. for 3 hours to produce a photosensitive layer.

The photoreceptor prepared in this manner was measured for its electrophotographic characteristics in the same manner as in Example 1. The results are shown in Table 8.

TABLE 8

| | Charge transfer material | Polymer binder | Charge generating material | $V_0$ (−v) | $V_i$ (−v) | $V_{R10}$ (−v) | $E_{1/2}$ (lux · s) | $E_{1/6}$ (lux · s) |
|---|---|---|---|---|---|---|---|---|
| Ex. 28 | Ex. compound 8 (ratio of trans-isomer: 0.92) | Poly-carbonate (A-2) | χ-$H_2$Pc | 989 | 905 | 0 | 1.25 | 2.74 |
| Ex. 29 | Ex. compound 10 (ratio of trans-isomer: 0.94) | Poly-carbonate (A-2) | χ-$H_2$Pc | 887 | 778 | 0 | 0.99 | 2.09 |
| Ex. 30 | Ex. compound 15 (ratio of trans-isomer: 0.84) | Poly-carbonate (B-1) | χ-$H_2$Pc | 1035 | 946 | 0 | 1.20 | 2.63 |
| Ex. 31 | Ex. compound 19 (ratio of trans-isomer: 0.88) | Poly-carbonate (B-1) | χ-$H_2$Pc | 1100 | 998 | 0 | 1.16 | 2.44 |
| Ex. 32 | Ex. compound 8 (ratio of trans-isomer: 0.91) (0.75 parts by weight) Compound (g) (0.25 parts by weight) | Poly-carbonate (B-1) | χ-$H_2$Pc | 916 | 816 | 0 | 1.05 | 2.23 |
| Comp. Ex. 14 | Comparative compound 1 (the same structural formula as the ex. comp. 12, ratio of trans-isomer: 0.14) | Poly-carbonate (B-1) | χ-$H_2$Pc | * | | | | |
| Comp. Ex. 15 | Comparative compound 2 | Poly-carbonate (B-1) | χ-$H_2$Pc | 1066 | 944 | 27 | 1.34 | 3.27 |

*Not dissolved in the polymer binder

While, one part by weight of the comparative compound 1 (the ratio of trans-isomer: 0.14) which had the same structure as that of example compound 12 but a lower ratio of trans-isomer and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane. However, the comparative compound 1 was not dissolved and hence the electrophotographic characteristics could not be measured.

As is clear from Table 8, it is understood that the electrophotographic photoreceptor comprising the example compounds have a sensitivity higher (the values of $E_{1/2}$ and $E_{1/6}$ are smaller) and a residual potential ($V_{R10}$) lower than those comprising the comparative compounds.

Example 33

Using polyvinyl butyral as the binder resin, a dispersion solution of oxotitanium phthalocyanine having crystal peaks at Bragg angles (2θ±0.2 degree) of 7.4, 9.3, 10.6, 13.2, 15.1, 15.7, 16.1, 20.8, 23.3, 26.3 and 27.1 degrees in a CuKαX-ray spectrum was applied to a thickness of 0.1 μm to an aluminum cylindrical drum with a diameter of 30 mm by dipping to form a charge generating layer.

Next, a polycarbonate Z resin (manufactured by Mitsubishi Gas Chemical Inc.) as the binding resin, a butadiene compound consisting of the example compound 8 (the ratio of trans-isomer:0.91) as the charge transfer agent and 2,6-di-tert-butyl-4-methylphenol as the antioxidant were formulated in a ratio by weight of 1.0:1.0:0.1 respectively and dissolved in chloroform to prepare a coating solution.

The coating solution was applied by dipping, followed by drying at 100° C. for one hour, to form a charge transfer layer with a thickness of 20 μm. An electrophotographic sensitive material was produced in the above manner.

Example 34

An electrophotographic photoreceptor was produced in the same manner as in Example 33 except that the ratio of the trans-isomer in the example compound 8 was altered from 0.91 to 0.86.

Example 35

An electrophotographic photoreceptor was produced in the same manner as in Example 33 except that the ratio of the trans-isomer in the example compound 8 was altered from 0.91 to 0.83.

Example 36

An electrophotographic photoreceptor was produced in the same manner as in Example 33 except that the ratio of trans-isomer in the example compound 8 was altered from 0.91 to 0.68.

Comparative Example 16

An electrophotographic photoreceptor was produced in the same manner as in Example 33 except that the comparative compound 3 which has the same chemical structure as the example compound 8, but has the ratio of trans-isomer of 0.57 was used instead of the example compound 8.

Comparative Example 17

A photoreceptor was produced in the same manner as in Example 33 except that a charge transfer agent composed of the comparative compound A shown in Table 9 was used instead of the example compound 8, and the ratio by weight of the binding resin/the comparative compound A/the antioxidant was 1.0/1.0/0.1.

The photoreceptors prepared in Examples 33–36 and Comparative Examples 16 and 17 were evaluated for its electrophotographic characteristics by using a photosensitive drum evaluation apparatus (Model-ELYSIA, manufactured by Trec JAPAN kabushiki kaisya) in the following condition (dynamic mode characteristics).

First, the photosensitive material was charged by means of −5 kV corona discharge for 5 seconds to measure the surface potential (initial potential: V01). The photosensitive material was energized and unenergized repeatedly while applying light at an intensity of 300 Lux to measure a potential after unenergized and after 100 cycles were finished, the potential being designated as a residual potential VR1. Moreover, the photosensitive material was energized and unenergized repeatedly while applying light at an intensity of 300 Lux to measure a residual potential VR2 after 1000 cycles were finished. Then, the value |VR2−VR1|=ΔVR was calculated and was designated as the variable potential. Each surface potential at 5° C., 25° C. and 50° C. was measured in the same manner as in the above measurement of initial surface potential to calculate a charged potential variation ΔV0 in an ambient temperature range between 5 and 50° C.

These results are shown in Table 10.

TABLE 9

A

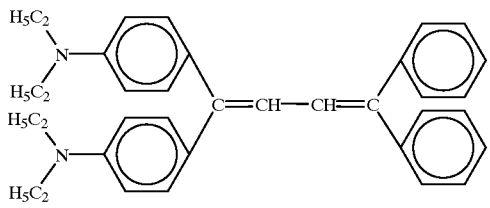

Comparative compound A

TABLE 10

| | Charge transfer layer (ratio of trans-isomer wt %) | (eV) IP value | Initial stage V01 (−V) | Initial stage VR1 (−V) | After 1000 cycles ΔVR (V) | 5–50° C. ΔV0 (V) |
|---|---|---|---|---|---|---|
| Ex. 33 | Ex. Compound 8 (0.91) | 5.12 | 720 | 20 | 0 | 20 |
| Ex. 34 | Ex. Compound 8 (0.86) | 5.15 | 715 | 50 | 5 | 20 |
| Ex. 35 | Ex. Compound 8 (0.83) | 5.16 | 720 | 55 | 5 | 20 |
| Ex. 36 | Ex. Compound 8 (0.68) | 5.18 | 720 | 60 | 10 | 18 |
| Comp. Ex. 16 | Comp. Compound 3 (0.57) | 5.20 | 725 | 80 | 50 | 15 |
| Comp. Ex. 16 | Comp. Compound A | 4.99 | 660 | 5 | 0 | 100 |

V01: Initial surface potential.
ΔV0: Difference of variation in surface potential at 5 to 50° C.
VR1: Initial residual potential (the potential measured after unenergized and after 100 cycles of an operation is finished in which operation the photosensitive material was energized and unenergized repeatedly while applying light at an intensity of 300 Lux).
ΔVR: Variable potential calculated by subtracting the initial residual potential from the residual potential after 1000 cycles.
IP value: Ionization potential (AC-1, Riken Keiki Kabushiki Kaisha).

As is understood from Examples 33 to 36 in Table 10, in the case of the electrophotographic photoreceptor comprising 60% by weight or more of a trans-isomer, the charged potential variation in an ambient temperature range between 5 and 50° C. is suppressed to 20 V or less and the residual potential variation after 1000 cycles are finished is 10 V or less.

On the other hand, the electrophotographic photoreceptor of Comparative Example 16 is increased in the residual potentials in the initial stage and after repeated cycles and cannot hence function as the photosensitive material.

The electrophotographic photoreceptor of Comparative Example 17 is low in the initial charged potential and is also as large as 100 V in the charged potential variation in an ambient temperature range between 5 and 50° C.

As mentioned above, it is confirmed that in the case where the amount of the trans-isomer represented by the formula (I) in the butadiene compounds represented by the formulae (I) and (II) is less than 60% by weight, the residual potential increases in the repetitive cycle test of over 1000 cycles whereas the electrophotographic photoreceptor comprising the 1-(p-diethylaminophenyl)-1,4,4-triphenylbutadiene derivative has such various excellent characteristics that it forms a stable film, has a large mobility and high sensitivity and is reduced in the residual potential.

It is considered that a difference in the contents of the trans-isomer and cis-isomer represented by the formulae (I) and (II) makes differences in the mobility and ionization potential and this greatly affects the characteristics against repetitive operations with the result that a carrier trap in the repeated use of the photoreceptor occurs and the residual potential on the photoreceptor increases.

Examples 37–40

The example compound 8 (the ratio of trans-isomer: 0.99) and the comparative compound 3 (which had the same structure as that of the example compound 8 but the ratio of trans-isomer was 0.01) were mixed to prepare four samples with different ratios of trans-isomer (over 0.6, specifically, 0.99, 0.86, 0.75, 0.6). One part by weight of each of these samples and one part by weight of a polycarbonate resin (Polycarbonate Z-200, manufactured by Mitsubishi Gas Chemical Inc.) represented by the structural formula (A-2) were mixed with and dissolved in 8 parts by weight of dichloroethane. Each resulting solution was applied to a sheet, produced by depositing aluminum on a polyethylene terephthalate (PET) film, by a doctor blade and was dried at 80° C. for 3 hours. A translucent gold electrode was further deposited on the charge transfer layer to measure the charge carrier mobility. The carrier mobility was measured using as a power source a nitrogen gas laser with a pulse half width of 0.9 nsec and a wavelength of 337 nm in a Time-of-flight method (Satoaki Tanaka, Yasuhiro Yamaguchi, Masaki Yokoyama: Electrophotograph, 29, 366 (1990)). The results of the measurement at 25° C. and 25 V/$\mu$m are shown in Table 11 and FIG. 3.

Comparative Examples 18–24

The example compound 8 (the ratio of trans-isomer: 0.99) and the comparative compound 3 (had the same structure as that of the example compound 8 but the ratio of trans-isomer was 0.01) were mixed to prepare 7 samples with different ratios of trans-isomer (less than 0.6, specifically, 0.50, 0.40, 0.30, 0.20, 0.10, 0.04, 0.01). Each resulting solution was treated in the same manner as in Examples 37–40 to prepare a sheet to measure the charge carrier mobility. The results are shown in Table 11 and FIG. 3.

TABLE 11

| | Charge transfer material | Polymer materials | Electron hole mobility ($cm^2/V_s$) |
|---|---|---|---|
| Ex. 37 | Ex. comp. 8 (ratio of trans-isomer: 0.99) | Polycarbonate (A-2) | $2.65 \times 10^{-6}$ |
| Ex. 38 | Ex. comp. 8 (ratio of trans-isomer: 0.86) | Polycarbonate (A-2) | $2.34 \times 10^{-6}$ |
| Ex. 39 | Ex. comp. 8 (ratio of trans-isomer: 0.75) | Polycarbonate (A-2) | $1.92 \times 10^{-6}$ |
| Ex. 40 | Ex. comp. 8 (ratio of trans-isomer: 0.60) | Polycarbonate (A-2) | $1.27 \times 10^{-6}$ |
| Comp. Ex. 18 | Comp. comp. 3 (the same structural formula as that of ex. Comp. 8, ratio of trans-isomer: 0.50) | Polycarbonate (A-2) | $1.03 \times 10^{-6}$ |
| Comp. Ex. 19 | Comp. comp. 3 (the same structural formula as that of ex. Comp. 8, ratio of trans-isomer: 0.40) | Polycarbonate (A-2) | $0.99 \times 10^{-6}$ |
| Comp. Ex. 20 | Comp. comp. 3 (the same structural formula as that of ex. Comp. 8, ratio of trans-isomer: 0.30) | Polycarbonate (A-2) | $0.60 \times 10^{-6}$ |
| Comp. Ex. 21 | Comp. comp. 3 (the same structural formula as that of ex. Comp. 8, ratio of trans-isomer: 0.20) | Polycarbonate (A-2) | $0.52 \times 10^{-6}$ |
| Comp. Ex. 22 | Comp. comp. 3 (the same structural formula as that of ex. Comp. 8, ratio of trans-isomer: 0.10) | Polycarbonate (A-2) | $0.42 \times 10^{-6}$ |
| Comp. Ex. 23 | Comp. comp. 3 (the same structural formula as that of ex. Comp. 8, ratio of trans-isomer: 0.04) | Polycarbonate (A-2) | $0.66 \times 10^{-6}$ |
| Comp. Ex. 24 | Comp. comp. 3 (the same structural formula as that of ex. Comp. 8, ratio of trans-isomer: 0.01) | Polycarbonate (A-2) | $1.12 \times 10^{-6}$ |

Figure 3:
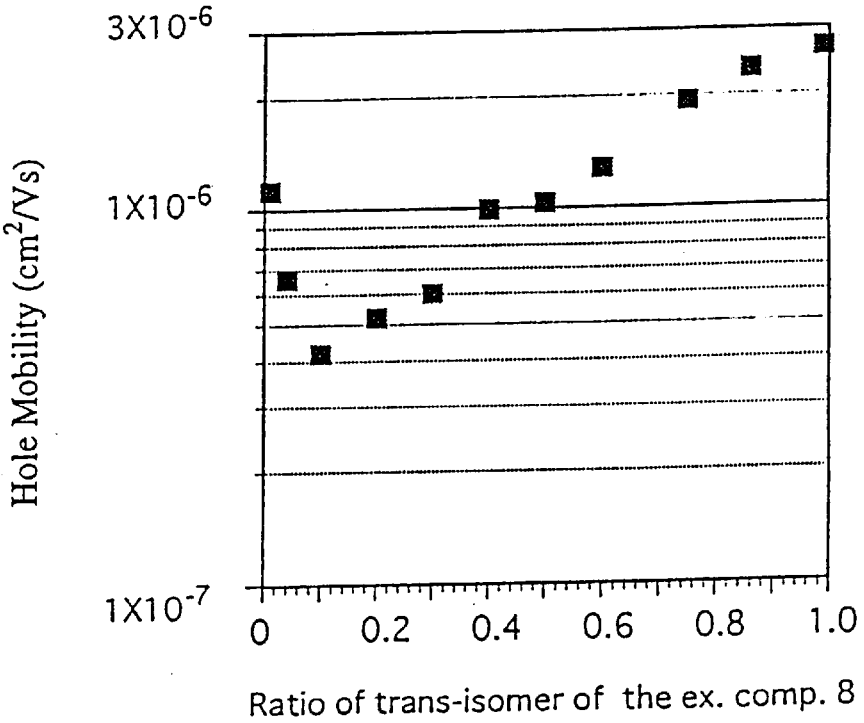
FIG. 3 is a view showing a variation in the mobility of a carrier when an example compound 8 (the ratio of trans-isomer: 0.99) and a comparative compound 3 (which has the same structure as that of the example compound 8 but the ratio of trans-isomer is as low as 0.01) are mixed in a desired ratio.

It is understood that from FIG. 3 that examples using the compounds containing primarily cis-isomer (the ratio of trans-isomer: 0.01) and examples using compounds with the ratio of trans-isomer being 0.5 exhibit almost the same mobility and examples using the compound with the ratio of trans-isomer being 0.6 or more have a mobility higher than those of the former examples.

Example 41

One part by weight of the example compound 10 (the ratio of trans-isomer: 0.94) and one part by weight of a polycarbonate resin (Polycarbonate Z-200, manufactured by Mitsubishi Gas Chemical Inc.) represented by the structural formula (A-2) were mixed with and dissolved in 8 parts by weight of dichloroethane. The resulting solution was applied to a sheet, produced by depositing aluminum on a polyethylene terephthalate (PET) film, by a doctor blade and was dried at 80° C. for 3 hours. A translucent gold electrode was further deposited on the charge transfer layer to measure the charge carrier mobility in the same manner as in Examples 37–40. The results are shown in Table 12.

Comparative Examples 25 and 26

The same procedures were carried out in the same manner as in Example 41, except that the comparative compounds 4 (the ratios of trans-isomer: 0.46 and 0.21) which had the same structure as that of the example compound 10 but a lower ratio of trans-isomer was used instead of the example compound 10, to prepare a sheet thereby measuring the carrier mobility. The results are shown in Table 12.

TABLE 12

| | Charge transfer material | Polymer materials | Electron hole mobility ($cm^2/V_s$) |
|---|---|---|---|
| Ex. 41 | Ex. comp. 10 (ratio of trans-isomer: 0.94) | Polycarbonate (A-2) | $1.93 \times 10^{-6}$ |
| Comp. Ex. 25 | Comp. comp. 4 (the same structural formula as that of ex. comp. 10, ratio of trans-isomer: 0.46) | Polycarbonate (A-2) | $0.81 \times 10^{-6}$ |
| Comp. Ex. 26 | Comp. comp. 4 (the same structural formula as that of ex. comp. 10, ratio of trans-isomer: 0.21) | Polycarbonate (A-2) | $0.62 \times 10^{-6}$ |

It is understood that from Table 12 that the photoreceptor comprising the example compound 10 having a high ratio of trans-isomer exhibits a mobility higher than that of each of the photoreceptor comprising the comparative compound 4 having the same structural formula as but the ratio of trans-isomer is lower than that of the example compound 10.

Example 42

One part by weight of the example compound 12 (the ratio of trans-isomer: 0.99) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The resulting solution was applied to a sheet, produced by depositing aluminum on a polyethylene terephthalate (PET) film, by a doctor blade and was dried at 80° C. for 3 hours. A translucent gold electrode was further deposited on the charge transfer layer to measure the charge carrier mobility in the same manner as in Examples 37–40. The results are shown in Table 13.

Comparative Example 27

Using the comparative compound 1 having the same structural formula as but the ratio of trans-isomer (the ratio of trans-isomer: 0.14) is lower than that of the example compound 12 in place of the example compound 12, one part by weight of the comparative compound 1 and one part by weight of a bisphenol A/biphenol-type copolymer polycarbonate resin (manufactured by Idemitsu Kosan Co., Ltd.) shown by the structural formula (B-1) were mixed with 8 parts by weight of dichloroethane, followed by trying to dissolve the former compounds in dichloroethane. However, the former compounds were not dissolved and hence the mobility could not been measured.

TABLE 13

| | Charge transfer material | Polymer materials | Electron hole mobility ($cm^2/V_s$) |
|---|---|---|---|
| Ex. 42 | Ex. comp. 12 (ratio of trans-isomer: 0.99) | Polycarbonate (B-1) | $5.48 \times 10^{-6}$ |
| Comp. Ex. 27 | Comp. comp. 1 (the same structural formula as that of ex. comp. 12, ratio of trans-isomer: 0.14) | Polycarbonate (B-1) | Undissolved in the polymer binder |

Example 43

One part by weight of the example compound 15 (the ratio of trans-isomer: 0.93) and one part by weight of a polycarbonate resin (Polycarbonate Z-200, manufactured by Mitsubishi Gas Chemical Inc.) represented by the structural formula (A-2) were mixed with and dissolved in 8 parts by weight of dichloroethane. The resulting solution was applied to a sheet, produced by depositing aluminum on a polyethylene terephthalate (PET) film, by a doctor blade and was dried at 80° C. for 3 hours. A translucent gold electrode was further deposited on the charge transfer layer to measure the charge carrier mobility in the same manner as in Examples 37–40. The results are shown in Table 14.

Comparative Example 28

The same procedures as in Example 42 were carried out, except that the comparative compound 5 having the same structural formula as but a ratio of trans-isomer (the ratio of trans-isomer: 0.54) lower than that of the example compound 15 was used instead of the example compound 15, to prepare a sheet thereby measuring the carrier mobility. The results are shown in Table 14.

TABLE 14

| | Charge transfer material | Polymer materials | Electron hole mobility ($cm^2/V_s$) |
|---|---|---|---|
| Ex. 43 | Ex. comp. 15 (ratio of transisomer: 0.93) | Polycarbonate (A-2) | $2.48 \times 10^{-6}$ |
| Comp. Ex. 28 | Comp. comp. 5 (the same structural formula as that of ex. comp. 15, ratio of transisomer: 0.54) | Polycarbonate (A-2) | $0.75 \times 10^{-6}$ |

It is understood that from Table 14 that the photoreceptor comprising the example compound 15 having a high ratio of trans-isomer has a mobility higher than that of the photoreceptor comprising the comparative compound 5 having the same structural formula as but a ratio of trans-isomer is lower than that of the example compound 15.

Example 44

One part by weight of the example compound 19 (the ratio of trans-isomer: 0.92) and one part by weight of a bisphenol A/biphenol-type copolymer polycarbonate resin (manufactured by Idemitsu Kosan Co., Ltd.) shown by the structural formula (B-1) were mixed with and dissolved in 8 parts by weight of dichloroethane. The resulting solution was applied to a sheet, produced by depositing aluminum on a polyethylene terephthalate (PET) film, by a doctor blade and was dried at 80° C. for 3 hours. A translucent gold electrode was further deposited on the charge transfer layer to measure the charge carrier mobility in the same manner as in Examples 37–40. The results are shown in Table 15.

Comparative Example 30

The same procedures as in Example 44 were carried out, except that the comparative compound 6 having the same structural formula as but a ratio of trans-isomer (the ratio of trans-isomer: 0.37) lower than that of the example compound 19 was used instead of the example compound 19, to prepare a sheet thereby measuring the carrier mobility. The results are shown in Table 15.

TABLE 15

| | Charge transfer material | Polymer materials | Electron hole mobility ($cm^2/V_s$) |
|---|---|---|---|
| Ex. 44 | Ex. comp. 19 (ratio of trans-isomer: 0.92) | Polycarbonate (B-1) | $2.71 \times 10^{-6}$ |
| Comp. Ex. 29 | Comp. comp. 6 (the same structural formula as that of ex. Comp. 19, ratio of trans-isomer: 0.37) | Polycarbonate (B-1) | $0.71 \times 10^{-6}$ |

It is understood that from Table 15 that the photoreceptor comprising the example compound 19 having a high ratio of trans-isomer has a mobility higher than that of the photoreceptor comprising the comparative compound having the same structural formula as but a ratio of trans-isomer lower than that of the example compound 19.

As stated above in detail, the charge transfer material of the present invention is highly soluble in a binder polymer and can hence form a stable and uniform photosensitive thin film layer with high density. Also, the charge transfer material of the present invention can form an electrophotographic photoreceptor with high sensitivity due to its high carrier mobility. Further, the charge transfer material of the present invention has low residual potential and enables the formation of an image with no fog on the background.

The present invention provides an electrophotographic photoreceptor having such excellent characteristics that a variation in the surface potential and a rise in the residual potential after repeated used are suppressed.

What is claimed is:

1. An electrophotographic photoreceptor comprising a butadiene compound represented by the formula (I):

(I)

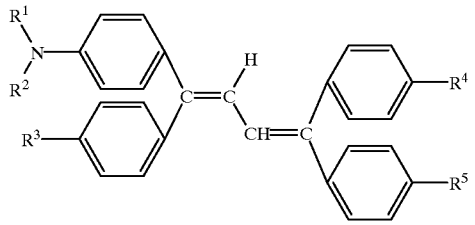

wherein $R^1$ and $R^2$, which are the same or different, represent a lower alkyl group having 1–4 carbon atoms or an optionally substituted phenyl group or an optionally substituted benzyl group and $R^3$, $R^4$ and $R^5$, which are the same or different, represent a hydrogen atom, a halogen atom, a lower alkyl group having 1–4 carbon atoms, a lower alkoxy group having 1–4 carbon atoms or a halogen atom; and a butadiene compound represented by the formula (II):

(II)

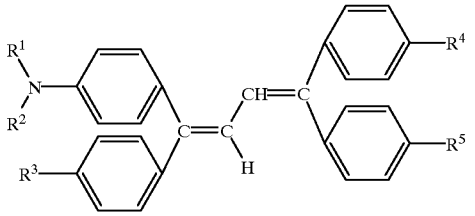

wherein $R^1$, $R^2$, $R^3$, $R^4$ and $R^5$ are the same as above, wherein the content of the butadiene compound represented by the formula (I) is at least 75% by weight based on the total amount by weight of the butadiene compounds represented by the formulae (I) and (II).

2. An electrophotographic photoreceptor comprising an electroconductive support on which a photosensitive layer is placed, said photosensitive layer containing at least a charge generating material, a charge transfer material and a binder resin, wherein the charge transfer material comprises a butadiene compound represented by the formula (I):

(I)

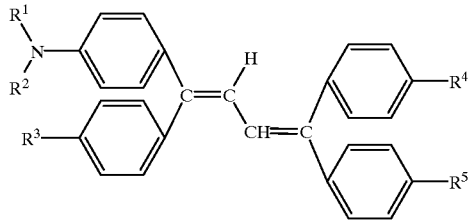

wherein $R^1$ and $R^2$, which are the same or different, represent a lower alkyl group having 1–4 carbon atoms or an optionally substituted phenyl group or an optionally substituted benzyl group and $R^3$, $R^4$ and $R^5$, which are the same or different, represent a hydrogen atom, a halogen atom, a lower alkyl group having 1–4 carbon atoms, a lower alkoxy group having 1–4 carbon atoms or a halogen atom; and a butadiene compound represented by the formula (II):

(II)

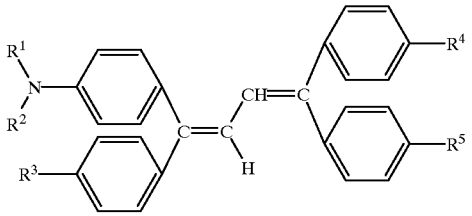

wherein $R^1$, $R^2$, $R^3$, $R^4$ and $R^5$ are the same as above, and the content of the butadiene compound represented by the formula (I) is at least 75% by weight based on the total amount by weight of the butadiene compounds represented by the formulae (I) and (II).

3. The electrophotographic photoreceptor according to claim 2, wherein the charge generating material in the photosensitive layer is a phthalocyanine pigment.

4. The electrophotographic photoreceptor according to claim 2, wherein the charge transfer material in the photosensitive layer comprises a butadiene compound represented by the formula (III):

(III)

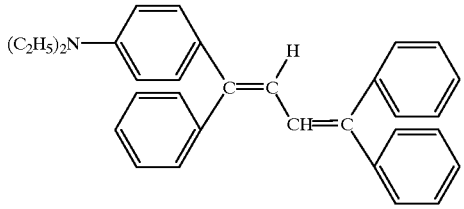

and a butadiene compound represented by the formula (IV):

(IV)

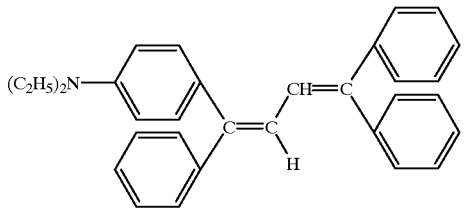

and the content of the butadiene compound represented by the formula (III) is at least 75% by weight based on the total amount by weight of the butadiene compounds represented by the formulae (III) and (IV).

* * * * *